US007074998B2

(12) United States Patent
Hurwicz

(10) Patent No.: US 7,074,998 B2
(45) Date of Patent: Jul. 11, 2006

(54) STRINGED INSTRUMENT TUNER HOLDER

(76) Inventor: Maxim Hurwicz, 224 N. 4th St., Stillwater, MN (US) 55082

( * ) Notice: Subject to any disclaimer, the term of this patent is extended or adjusted under 35 U.S.C. 154(b) by 302 days.

(21) Appl. No.: 10/398,098

(22) PCT Filed: Oct. 2, 2001

(86) PCT No.: PCT/US01/30903

§ 371 (c)(1),
(2), (4) Date: Apr. 1, 2003

(87) PCT Pub. No.: WO02/29779

PCT Pub. Date: Apr. 11, 2002

(65) Prior Publication Data

US 2004/0123723 A1 Jul. 1, 2004

Related U.S. Application Data

(60) Provisional application No. 60/237,336, filed on Oct. 2, 2000.

(51) Int. Cl.
*G10H 7/02* (2006.01)

(52) U.S. Cl. ..... 84/454; 84/455

(58) Field of Classification Search ..... 84/453–455, 84/458; 248/211, 304, 225.21; 206/305, 206/314, 320; 211/85.6, 90.01, 113, 134
See application file for complete search history.

(56) References Cited

U.S. PATENT DOCUMENTS

| | | | | |
|---|---|---|---|---|
| 1,697,508 | A | | 1/1929 | Kordick |
| D212,645 | S | | 11/1968 | Garvey |
| 3,437,002 | A | | 4/1969 | Urban et al. |
| 3,691,894 | A | | 9/1972 | Schneider et al. |
| 3,704,646 | A | | 12/1972 | Davis et al. |
| 4,104,947 | A | * | 8/1978 | Oster ..... 84/318 |
| 4,165,554 | A | * | 8/1979 | Faget ..... 16/426 |
| 4,168,647 | A | * | 9/1979 | Petillo ..... 84/731 |
| D279,905 | S | | 7/1985 | Whited |
| 4,889,029 | A | | 12/1989 | St. Denis |
| 4,899,636 | A | | 2/1990 | Chiba et al. |
| 5,105,711 | A | * | 4/1992 | Barnard ..... 84/744 |
| D353,826 | S | | 12/1994 | Mayo |
| 5,409,107 | A | * | 4/1995 | Browne ..... 206/305 |
| 5,539,706 | A | * | 7/1996 | Takenaka et al. ..... 368/10 |

(Continued)

*Primary Examiner*—Marlon T. Fletcher
*Assistant Examiner*—David Warren
(74) *Attorney, Agent, or Firm*—Gerald T. Bodner

(57) ABSTRACT

A tuner holder for stringed instruments. A first embodiment includes (i) a strut, (ii) a shelf extending substantially perpendicular in a first longitudinal direction from the distal edge of the strut, (iii) a hook extending in a second longitudinal direction from the proximal edge of the strut, and (iv) a means for securing a tuner to the holder. A second embodiment includes (i) an enclosure defining a retention chamber with a first access opening into the retention chamber through the top of the enclosure and a second access opening into the retention chamber through the front of the enclosure, and (ii) a hook longitudinally extending from the back of the enclosure away from the retention chamber. A third embodiment of the invention includes (i) a strut, (ii) a connection element effective for holding a tuner and pivotally attached to the strut proximate the distal end of the strut for pivoting about a lateral axis as between at least a storage position and a tuning position, and (iii) a hook extending in a second longitudinal direction from the proximal edge of the strut. A fourth embodiment of the invention is an assembly which includes (i) a tuner housing, and (ii) a hook extending from the bottom wall of the housing.

34 Claims, 38 Drawing Sheets

U.S. PATENT DOCUMENTS 5,637,820 A * 6/1997 Wittman ..... 84/454
5,728,959 A 3/1998 O'Rorke
5,777,248 A 7/1998 Campbell
5,852,250 A * 12/1998 Cha ..... 84/327
5,872,702 A * 2/1999 Kopel ..... 361/810
5,990,403 A * 11/1999 Membreno et al. ..... 84/454
6,105,763 A * 8/2000 Saetia ..... 206/320
6,257,535 B1 * 7/2001 Jaing ..... 248/205.5
6,291,755 B1 9/2001 Hine et al.
6,482,239 B1 * 11/2002 Jones et al. ..... 84/458
6,576,822 B1 * 6/2003 Grace ..... 84/327

* cited by examiner

STRINGED INSTRUMENT TUNER HOLDER

This application claims the benefit of U.S. Provisional Application No. 60/237,336, filed Oct. 2, 2000.

FIELD OF THE INVENTION

The present invention relates to stringed instrument tuner holders, and more specifically guitar tuner holders.

BACKGROUND

Stringed instruments, such as guitars, are typically tuned through the use of an electronic tuner which is capable of detecting the frequency of vibration generated by plucking, striking, or stroking a single string on the instrument and communicating any difference between the frequency of the generated vibration and a target frequency on a standard musical scale.

When using a tuner, it is necessary to position the tuner so that the visual tuning display, which communicates the difference between the frequency of the generated vibration and the target frequency, is visible to the person tuning the instrument. It is also generally desired to position the tuner close to the sound hole of the instrument with the transducer (e.g., a microphone) facing the sound hole in order to maximize reception of sound from the instrument while minimizing any external interference. In an effort to attain these goals while also keeping both hands free to hold, play and tune the instrument, a number of tuner holders have been developed.

U.S. Pat. No. 5,728,959 describes a clamping holder for a tuner for mounting a tuner on a microphone stand. While effective for positioning the tuner so that the visual tuning display is visible to the person tuning the instrument and the transducer faces the sound hole of the instrument, the tuner is mounted a significant distance from the sound hole of the instrument.

U.S. Pat. No. 4,899,636 describes a guitar tuner, which incorporates a suction cup to mount the tuner to the guitar body. While generally effective for allowing positioning of the tuner proximate the sound hole with the transducer facing the sound hole and the visual tuning display viewable by the person tuning the guitar, guitar owners are very reluctant to attach such a device to the body of their guitar due to the high probability that the suction cup will mark, scratch, or otherwise damage the guitar body.

U.S. Pat. No. Des. 353,826 depicts a guitar tuner holder configured and arranged for suspending a platform from the sound hole of a guitar. The holder includes a centrally located upper knob extending downward from the back edge of the platform for engaging the inner surface of the guitar body through the sound hole, and a pair of laterally spaced lower knobs extending rearward from right and left legs for engaging the outer surface of the guitar body immediately below the sound hole. While generally effective for allowing positioning of the tuner proximate the sound hole in an orientation which allows the person tuning the guitar to view the visual tuning display of the tuner, the platform extends straight out from the sound hole resulting in a positioning of the tuner immediately in front of the guitar strings such that the tuner interferes with playing of the guitar strings and the transducer is positioned above at least some of the guitar strings.

Accordingly, a need exists for a tuner holder which positions a tuner proximate the sound hole of a stringed instrument with the transducer facing the sound hole and the visual tuning display viewable by the person tuning the instrument, without interfering with playing of the instrument.

SUMMARY OF THE INVENTION

The invention is an inexpensive tuner holder for stringed instruments capable of positioning a tuner proximate the sound hole of the instrument with the transducer facing the sound hole and the visual tuning display viewable by the person tuning the instrument, without interfering with playing of the instrument strings.

First Embodiment

A first embodiment of the invention is a tuner holder which includes (i) a strut, (ii) a shelf extending substantially perpendicular in a first longitudinal direction from the distal edge of the strut, (iii) a hook extending in a second longitudinal direction from the proximal edge of the strut, and (iv) a means for securing a tuner to the holder.

The holder may optionally include (v) a transducer for sensing vibration generated by playing a string on a stringed instrument and converting the vibration to an electrical signal, and (vi) a means for electrically connecting the transducer to a tuner secured to the holder for transmitting the electric signal from the transducer to the tuner.

Tuning of a stringed instrument utilizing the first embodiment of the invention includes the steps of (i) securing a tuner to the holder, (ii) hanging the tuner from the instrument proximate the sound hole by hooking the holder onto the instrument at the sound hole, (iii) playing a string on the instrument so as to generate a vibration having a frequency, and (iv) adjusting the tension on the played string based upon a perceptible signal generated by the tuner indicating the frequency of the vibration relative to a target frequency on a standard musical scale.

Tuning of a stringed instrument utilizing the first embodiment of the invention when the holder includes a transducer includes the steps of (i) securing a tuner to the holder, (ii) electrically connecting the tuner to the transducer, (iii) hanging the tuner from the instrument proximate the sound hole by hooking the holder onto the instrument at the sound hole, (iv) playing a string on the instrument so as to generate a vibration having a frequency and thereby effect (a) generation of an electrical signal by the transducer corresponding to the frequency of the vibration, (b) transmission of the electrical signal from the transducer to the tuner, and (c) generation of a perceptible signal by the tuner representative of any difference between the frequency of the vibration and a target frequency on a standard musical scale, and (v) adjusting the tension on the played string based upon the perceptible signal.

Second Embodiment

A second embodiment of the invention is a tuner holder which includes (i) an enclosure defining a retention chamber, and (ii) a hook longitudinally extending from the enclosure away from the retention chamber and defining a concavity accessible in a first transverse direction. The enclosure has (a) a front longitudinally spaced from a back, (b) a top transversely spaced from a bottom, (c) a right side laterally spaced from a left side, (d) an access opening into the retention chamber through the top of the enclosure, and (e) an access opening into the retention chamber through the front of the enclosure. The access opening through the top of the enclosure is configured and arranged to permit a major portion of a given tuner to be slidably introduced in a second transverse direction and engaged within the retention chamber in a storage orientation relative to the enclosure. The access opening through the front of the enclosure is configured and arranged to permit a minor portion of the same given tuner to be slidably introduced and engaged within the retention chamber in a tuning orientation.

The tuner holder may optionally include (iii) a transducer for sensing vibration generated by playing a string on a stringed instrument and converting the vibration to an electrical signal, and (iv) a means for electrically connecting the transducer to a tuner secured to the holder for transmitting the electric signal from the transducer to the tuner.

Tuning of a stringed instrument utilizing the second embodiment of the invention includes the steps of (i) securing a tuner to the holder in the tuning orientation, (ii) hanging the tuner from the instrument proximate the sound hole by hooking the holder onto the instrument at the sound hole, (iii) playing a string on the instrument so as to generate a vibration having a frequency, and (iv) adjusting the tension on the played string based upon a perceptible signal generated by the tuner indicating the frequency of the vibration relative to a target frequency on a standard musical scale.

Tuning of a stringed instrument utilizing the second embodiment of the invention when the holder includes a transducer includes the steps of (i) securing a tuner to the holder in the tuning orientation, (ii) electrically connecting the tuner to the transducer, (iii) hanging the tuner from the instrument proximate the sound hole by hooking the holder onto the guitar at the sound hole, (iv) playing a string on the instrument so as to generate a vibration having a frequency and thereby effect (a) generation of an electrical signal by the transducer corresponding to the frequency of the vibration, (b) transmission of the electrical signal from the transducer to the tuner, and (c) generation of a perceptible signal by the tuner representative of any difference between the frequency of the vibration and a target frequency on a standard musical scale, and (v) adjusting the tension on the played string based upon the perceptible signal.

Third Embodiment

A third embodiment of the invention is a tuner holder which includes (i) a strut having transversely spaced distal and proximal ends, (ii) a connection element effective for holding a tuner which is pivotally attached to the strut proximate the distal end of the strut for pivoting about a lateral axis as between at least a storage position and a tuning position wherein at least a portion of the connection element extends on a first longitudinal direction when in the storage and tuning positions, and (iii) a hook extending in a second longitudinal direction from proximate the proximal edge of the strut.

The holder may optionally include (iv) a transducer for sensing vibration generated by playing a string on a stringed instrument and converting the vibration to an electrical signal, and (v) a means for electrically connecting the transducer to a tuner held by the connection element for transmitting the electric signal from the transducer to the tuner.

Tuning of a stringed instrument utilizing the third embodiment of the invention includes the steps of (i) securing a tuner to the connection element in the tuning position, (ii) hanging the tuner from the instrument proximate the sound hole by hooking the holder onto the instrument at the sound hole, (iii) playing a string on the instrument so as to generate a vibration having a frequency, and (iv) adjusting the tension on the played string based upon a perceptible signal generated by the tuner indicating the frequency of the vibration relative to a target frequency on a standard musical scale.

Tuning of a stringed instrument utilizing the third embodiment of the invention when the holder includes a transducer includes the steps of (i) securing a tuner to the connection element in the tuning position, (ii) electrically connecting the tuner to the transducer, (iii) hanging the tuner from the instrument proximate the sound hole by hooking the holder onto the instrument at the sound hole, (iv) playing a string on the instrument so as to generate of a vibration having a frequency and thereby effect (a) generation of an electrical signal by the transducer corresponding to the frequency of the vibration, (b) transmission of the electrical signal from the transducer to the tuner, and (c) generation of a perceptible signal by the tuner representative of any difference between the frequency of the vibration and a target frequency on a standard musical scale, and (v) adjusting the tension on the played string based upon the perceptible signal.

Fourth Embodiment

A fourth embodiment of the invention is an assembly which includes (i) a tuner including at least (a) a housing, (b) a transducer, and (c) a visual tuning display, and (ii) a hook. The housing has longitudinally spaced top and bottom walls with an exterior surface of the top wall facing a first longitudinal direction and an exterior surface of the bottom wall facing a second longitudinal direction, and (ii) transversely spaced front and back walls with an exterior surface of the front wall facing a first transverse direction and an exterior surface of the back wall facing a second transverse direction. The visual tuning display is positioned on the front wall of the housing. The hook extends from the housing in the second longitudinal direction with the concavity defined by the hook accessible in the first transverse direction.

Tuning of a stringed instrument utilizing the fourth embodiment of the invention includes the steps of (i) hanging the assembly from the instrument proximate the sound hole by hooking the assembly onto the instrument at the sound hole, (ii) playing a string on the instrument so as to generate a vibration having a frequency, and (iii) adjusting the tension on the played string based upon a perceptible signal generated by the tuner indicating the frequency of the vibration relative to a target frequency on a standard musical scale.

BRIEF DESCRIPTION OF THE DRAWINGS

First Embodiment

Second Embodiment

Figure 23:
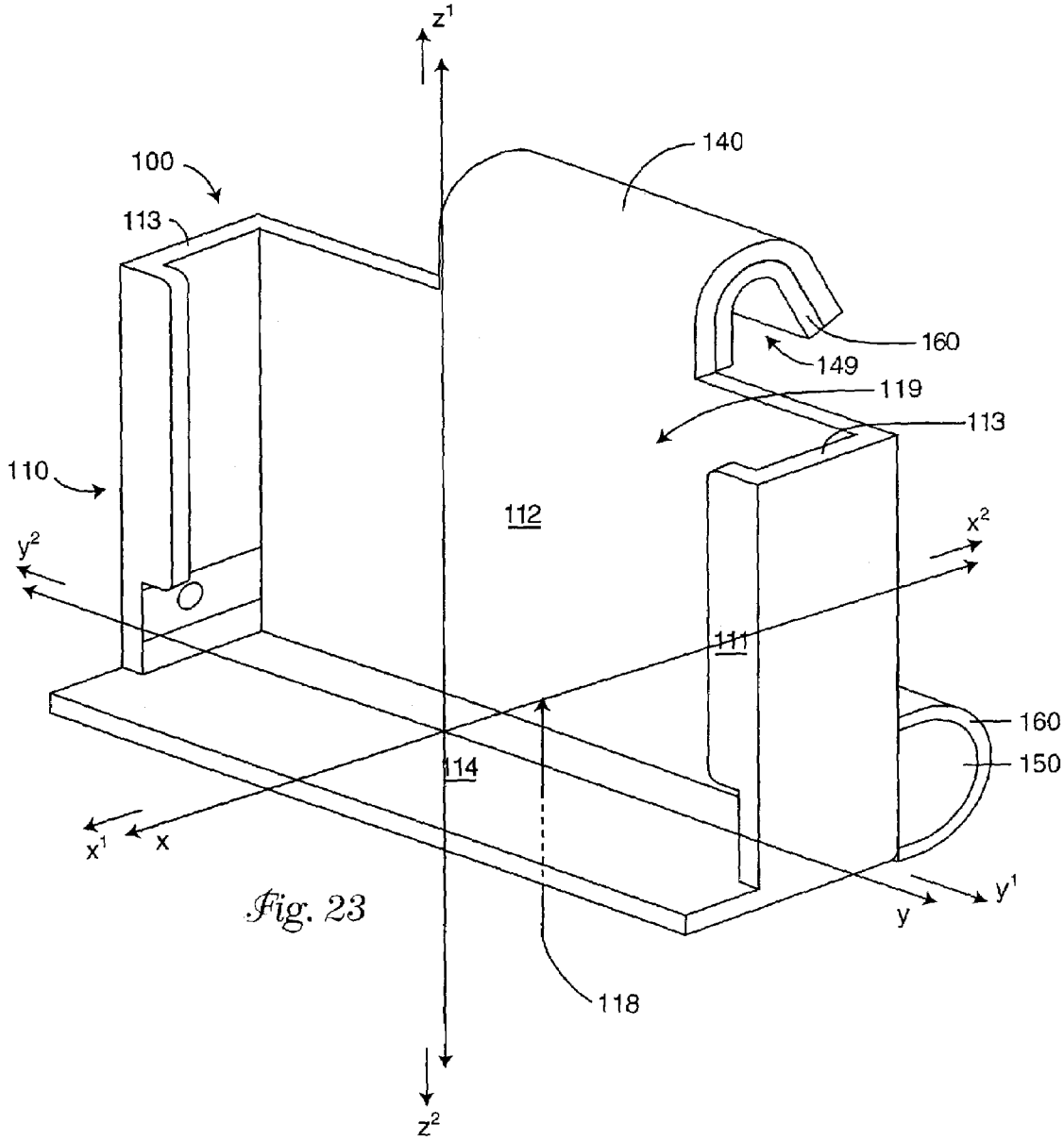

FIG. 23 is a front perspective view of a second embodiment of the invention.

Figure 24:
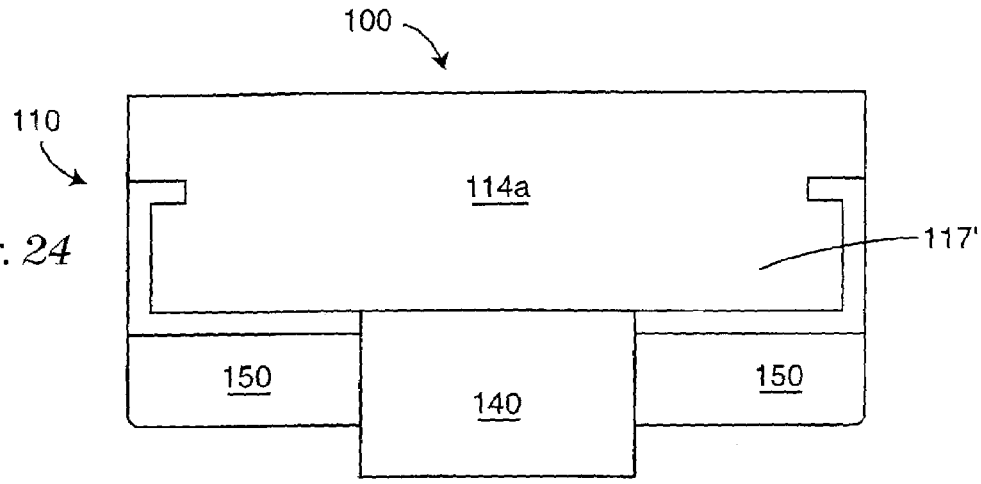

FIG. 24 is a top view of the invention shown in FIG. 23.

Figure 25:
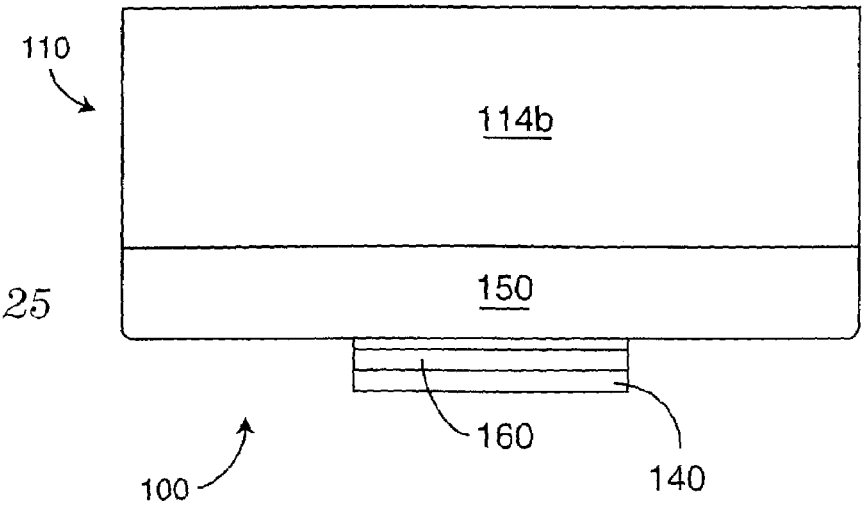

FIG. 25 is a bottom view of the invention shown in FIG. 23.

Figure 26:
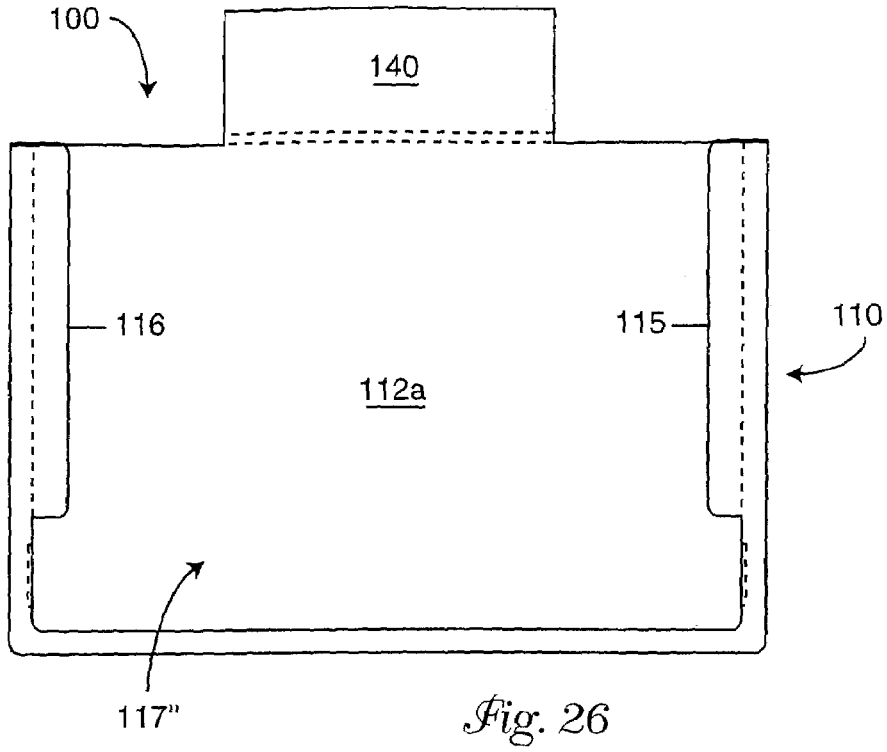

FIG. 26 is a front view of the invention shown in FIG. 23.

Figure 27:
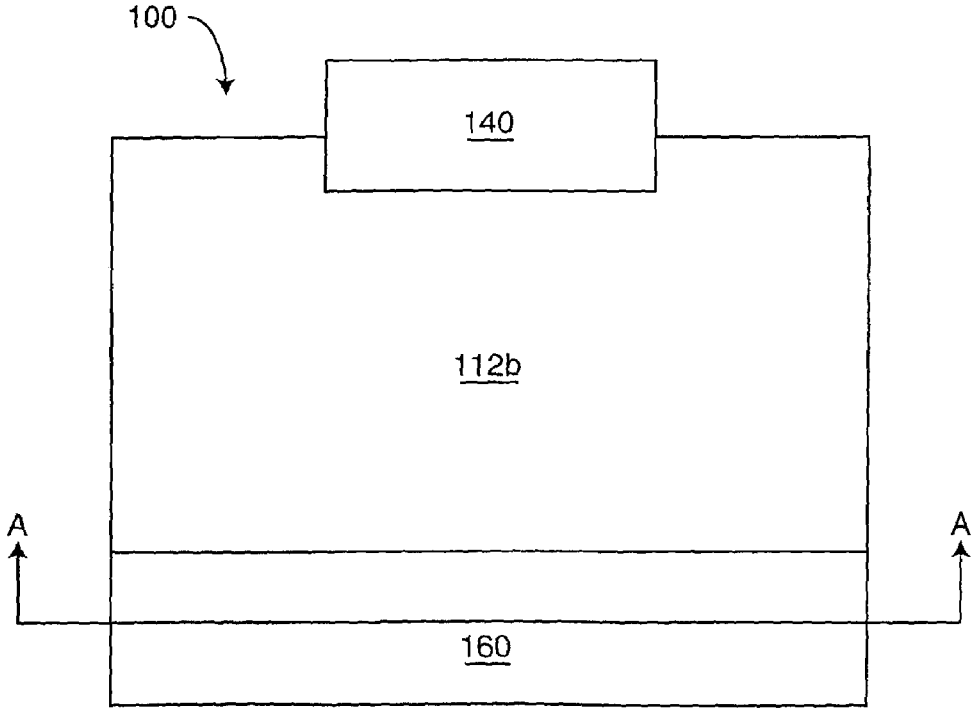

FIG. 27 is a back view of the invention shown in FIG. 23.

Figure 28:
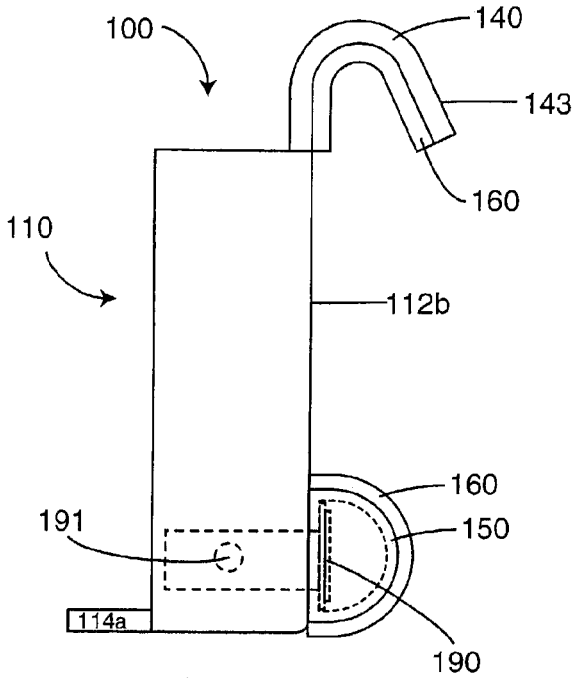

FIG. 28 is a right side view of the invention shown in FIG. 23.

Figure 29:
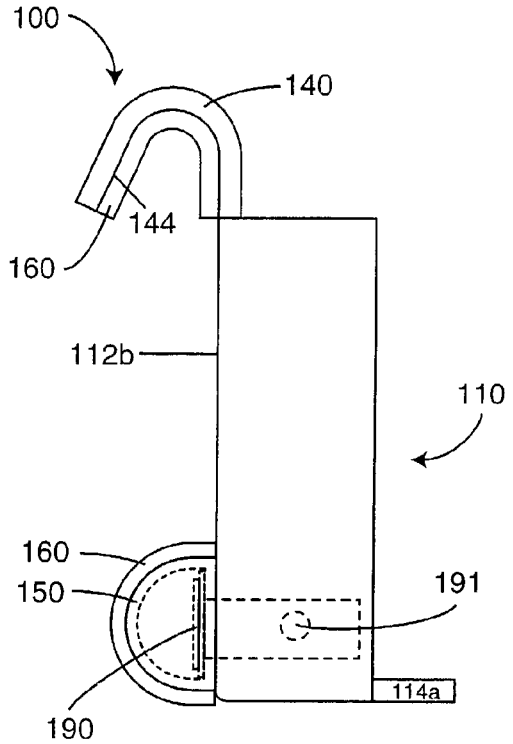

FIG. 29 is a left side view of the invention shown in FIG. 23.

Figure 30:
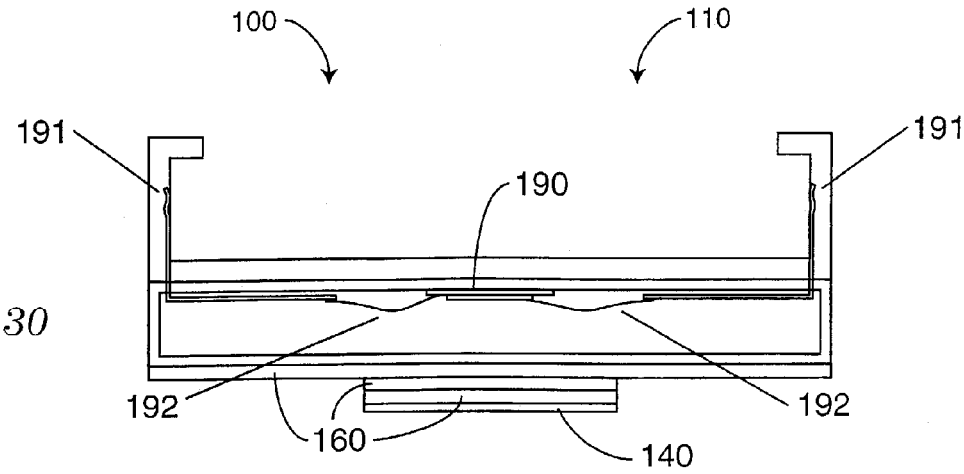

FIG. 30 is a cross-sectional view of the invention shown in FIG. 27 taken along line A—A.

Figure 31:
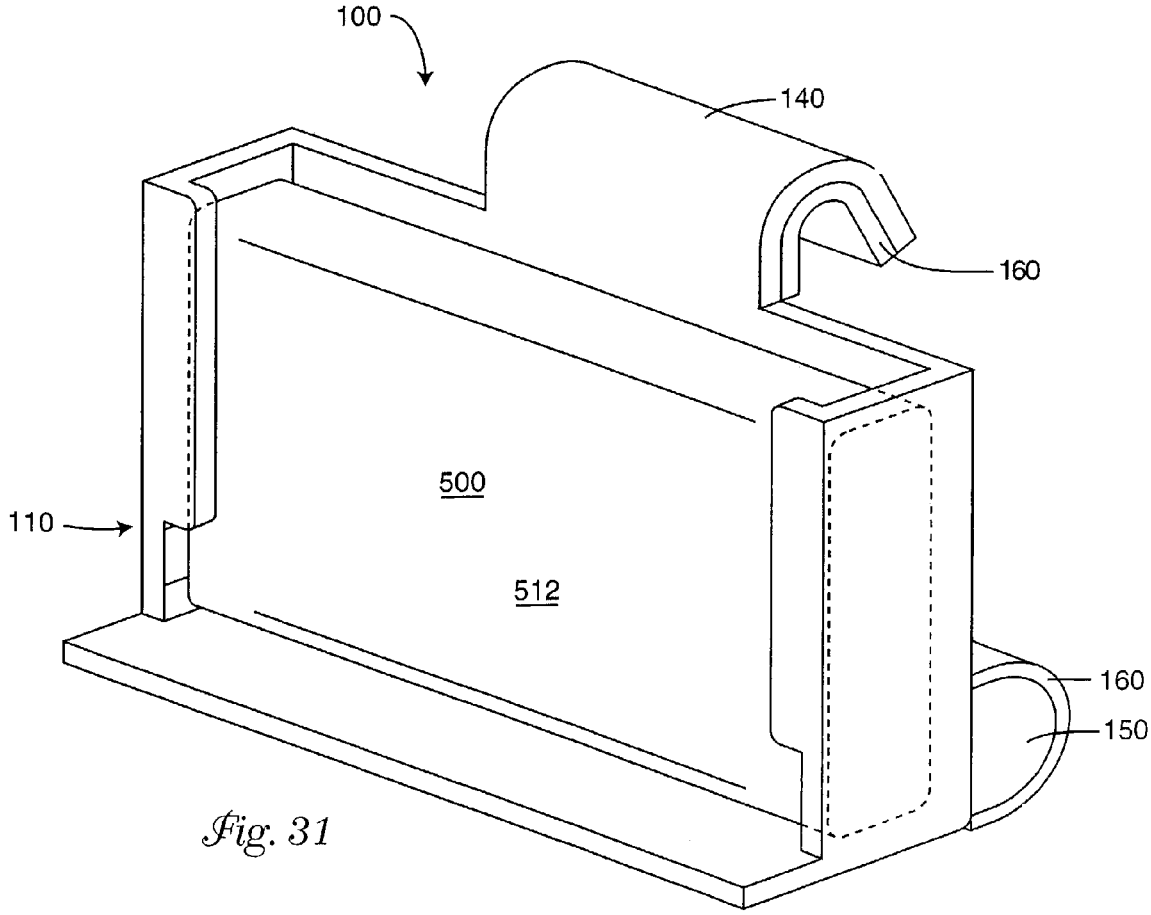

FIG. 31 is a front perspective view of the invention shown in FIG. 23 holding a tuner in the storage position.

Figure 32:
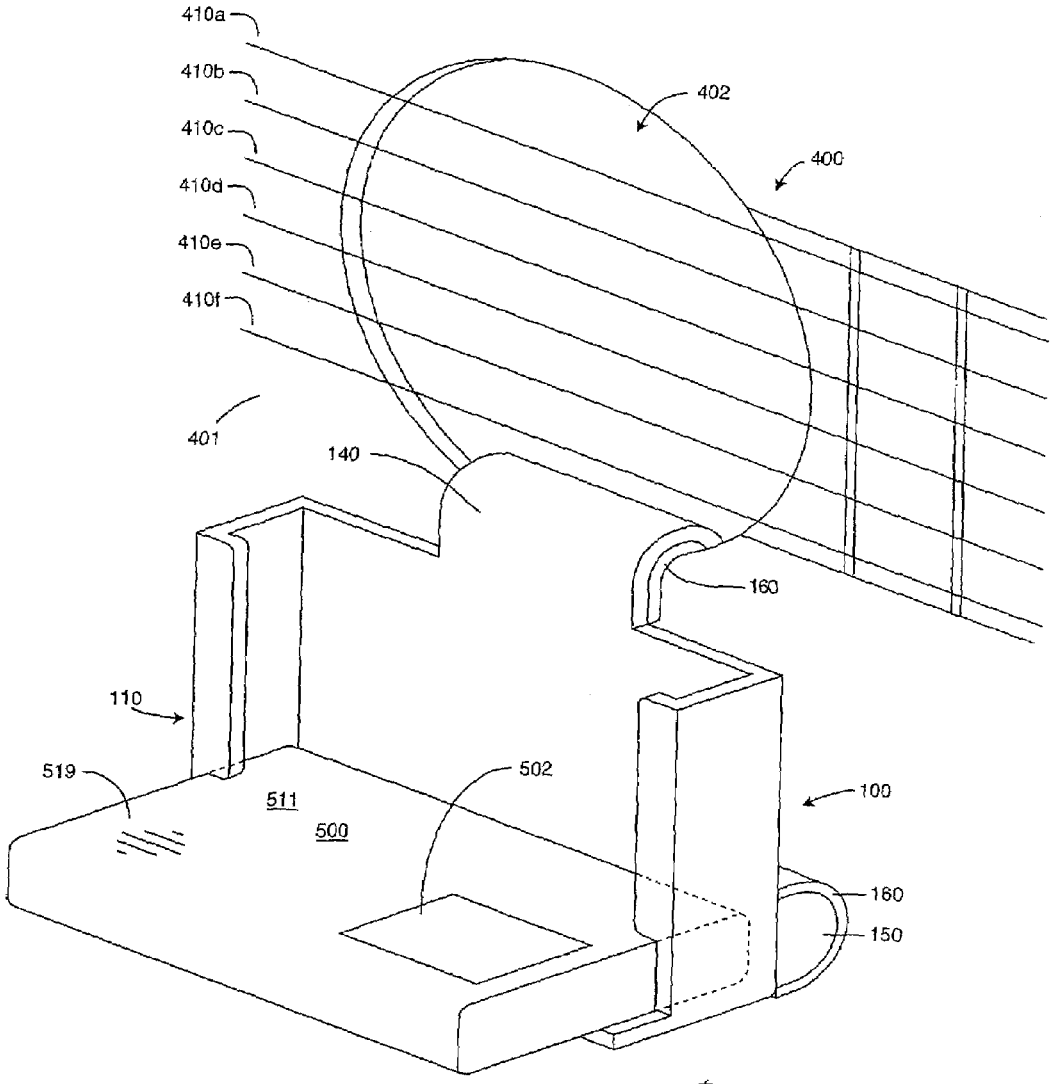

FIG. 32 is a front perspective view of the invention shown in FIG. 23 suspended from the sound hole of a guitar and holding a tuner in the tuning position.

Third Embodiment

Figure 33:
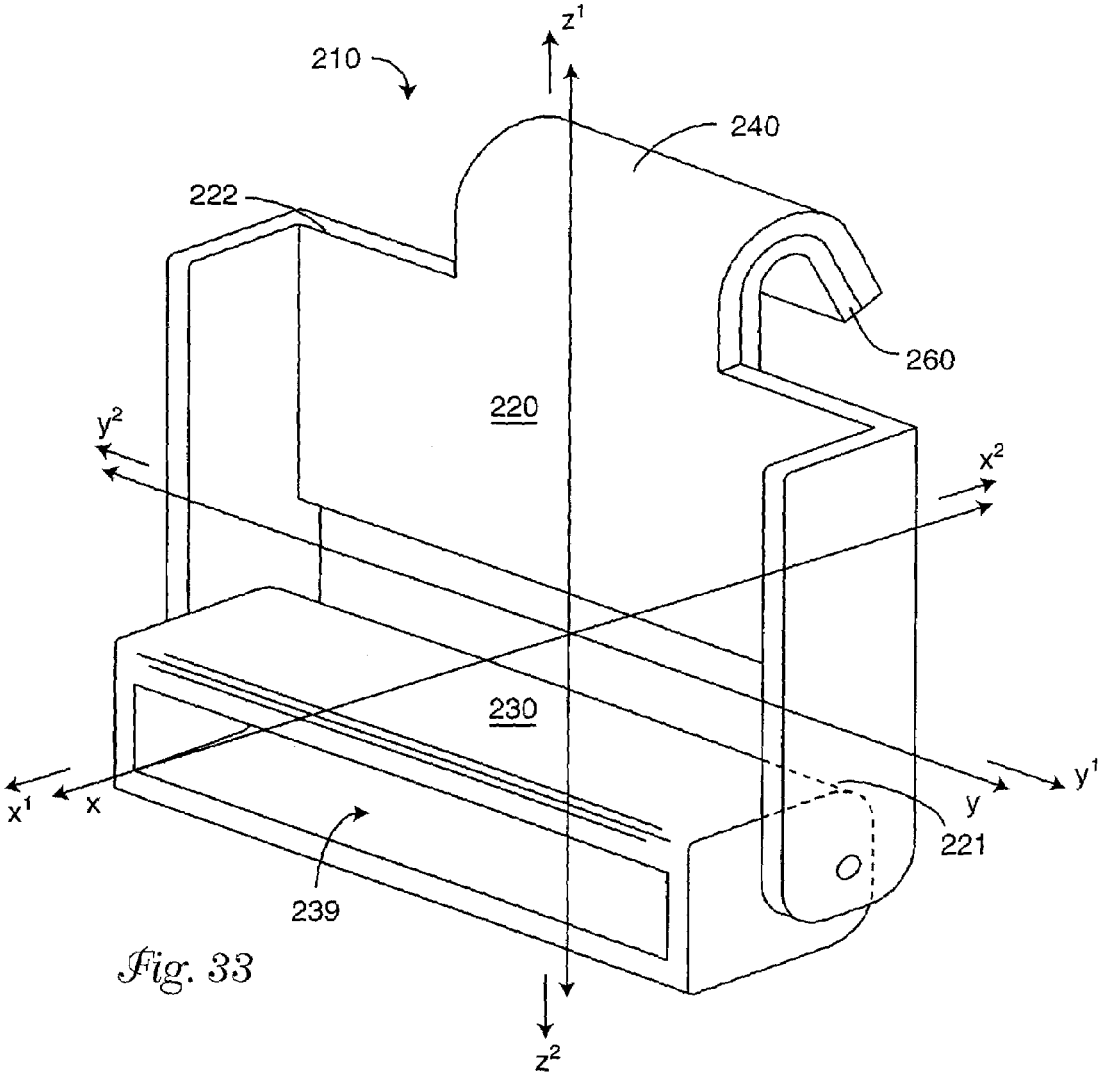

FIG. 33 is a front perspective view of a third embodiment of the invention with the connection element pivoted into the tuning position.

Figure 34:
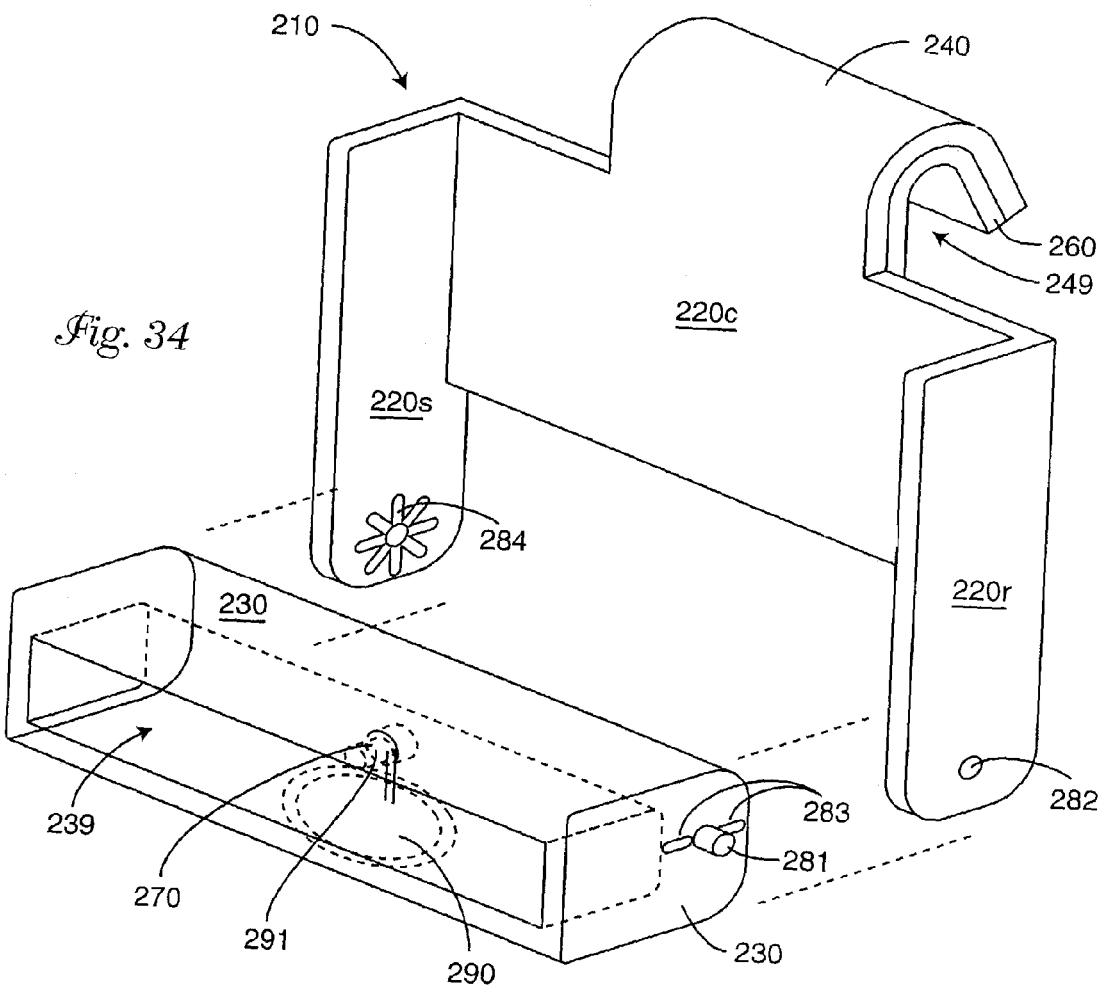

FIG. 34 is an exploded perspective view of the invention shown in FIG. 33.

Figure 35:
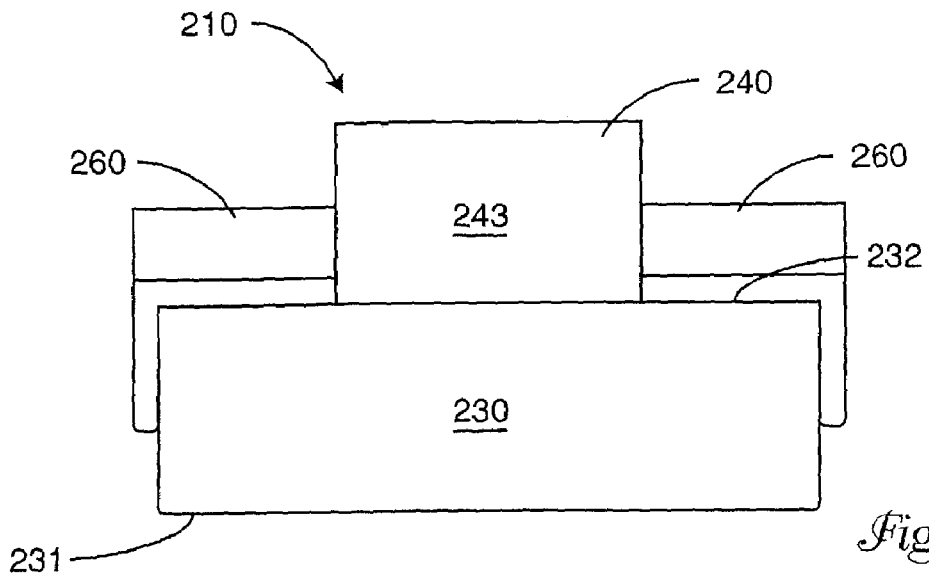

FIG. 35 is atop view of the invention shown in FIG. 33.

Figure 36:
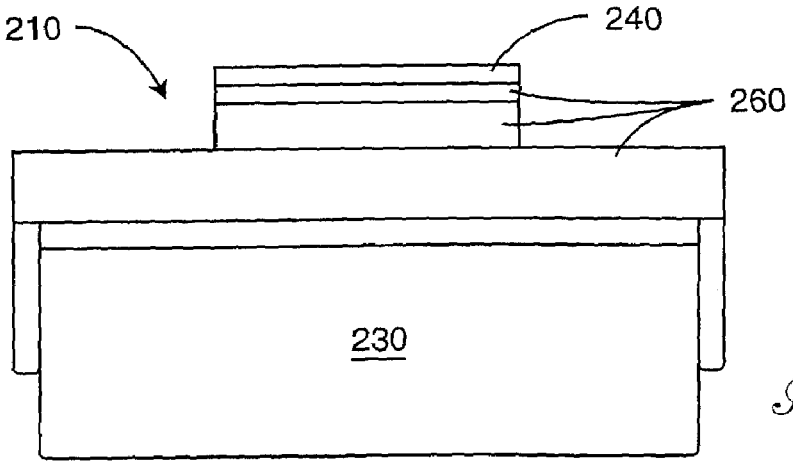

FIG. 36 is a bottom view of the invention shown in FIG. 33.

Figure 37:
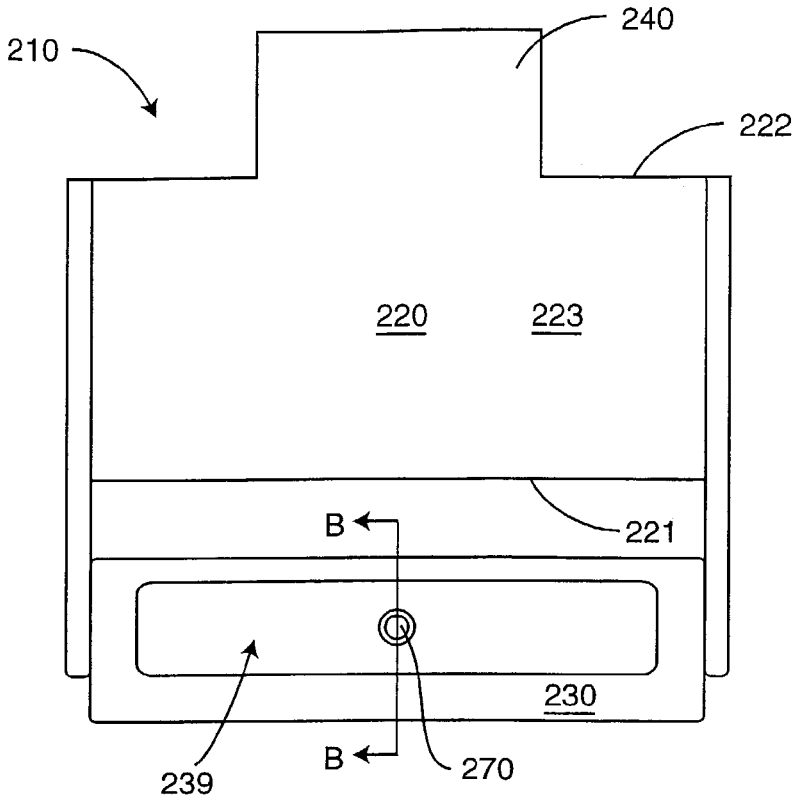

FIG. 37 is a front view of the invention shown in FIG. 33.

Figure 38:
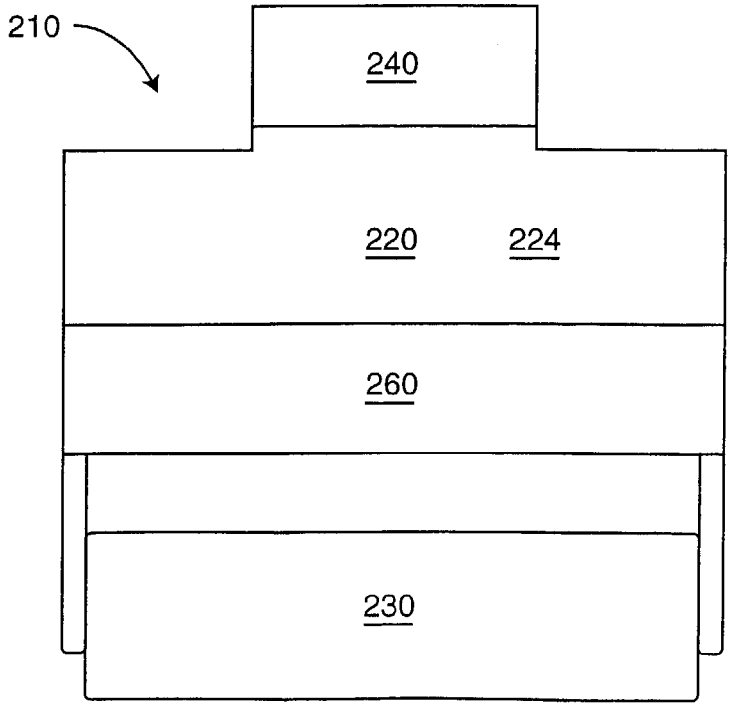

FIG. 38 is a back view of the invention shown in FIG. 33.

Figure 39:
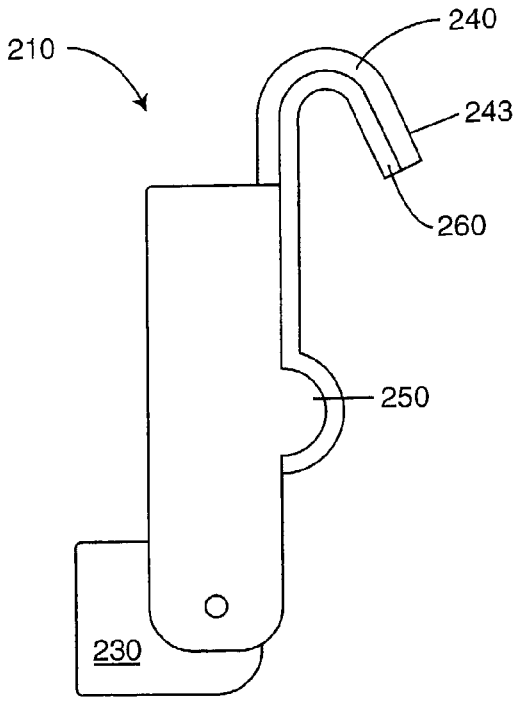

FIG. 39 is a right side view of the invention shown in FIG. 33.

Figure 40:
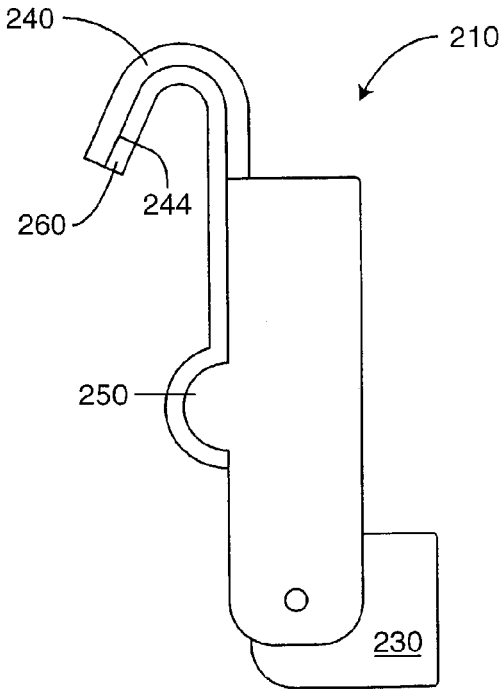

FIG. 40 is a left side view of the invention shown in FIG. 33.

Figure 41:
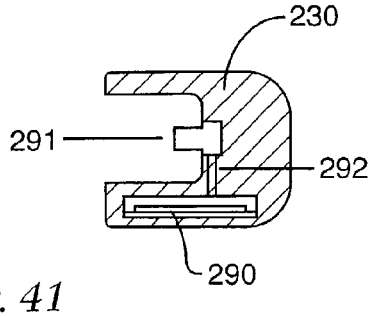

FIG. 41 is a cross-sectional view of the connection element portion of the invention shown in FIG. 37 taken along line B—B.

Figure 42:
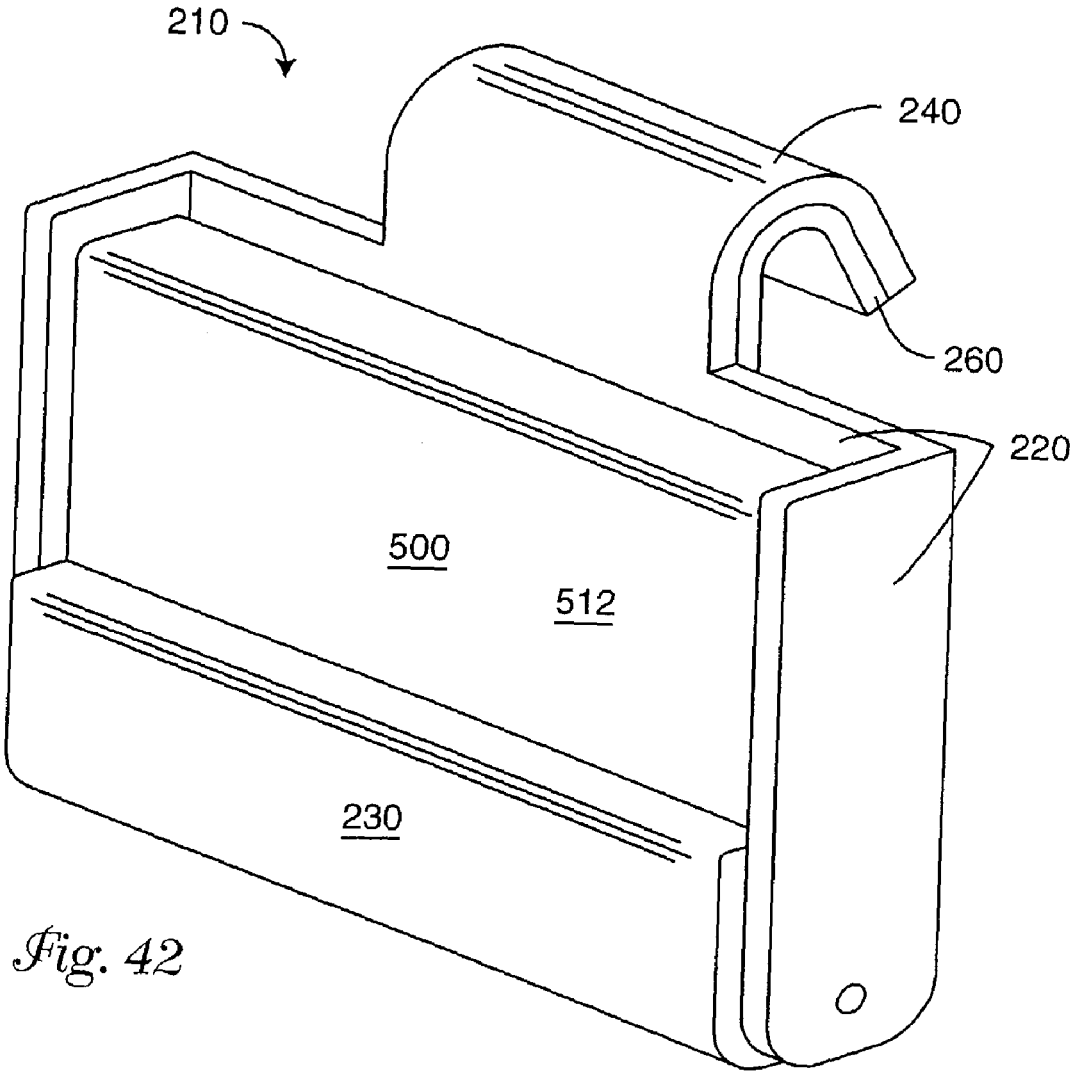

FIG. 42 is a front perspective view of the invention shown in FIG. 33 holding a tuner in the storage position.

Figure 43:
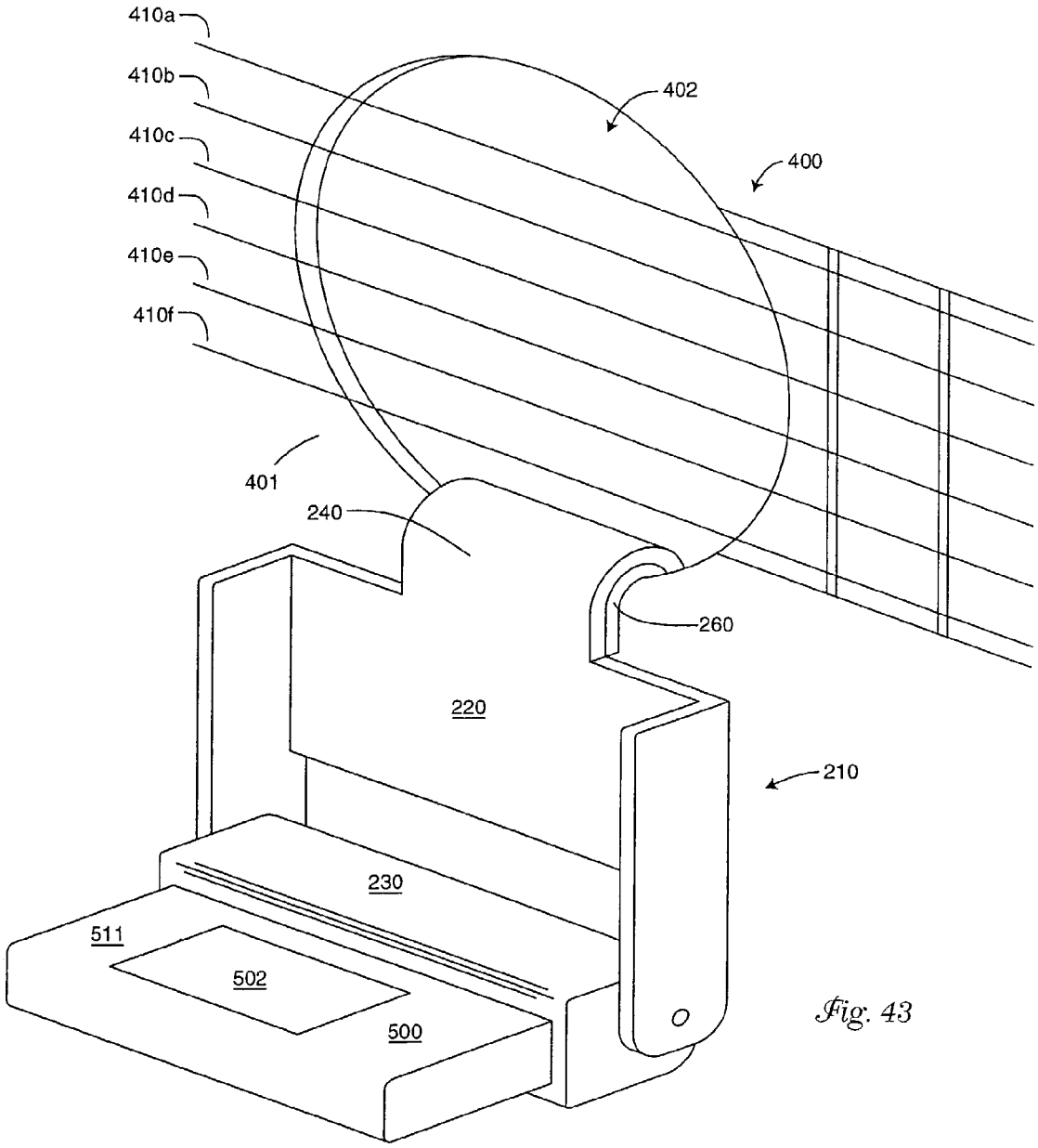

FIG. 43 is a front perspective view of the invention shown in FIG. 33 suspended from the sound hole of a guitar and holding a tuner in the tuning position.

Figure 44:
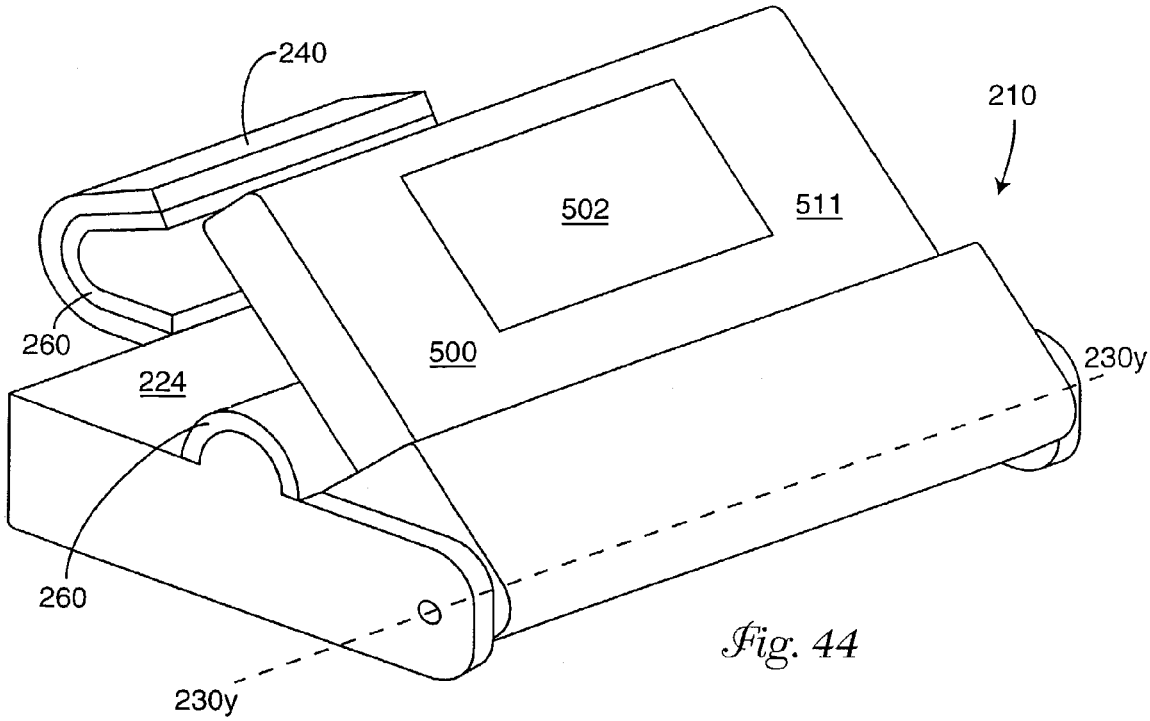

FIG. 44 is a rear perspective view of the invention shown in FIG. 33 holding a tuner in the display position.

Fourth Embodiment

Figure 45:
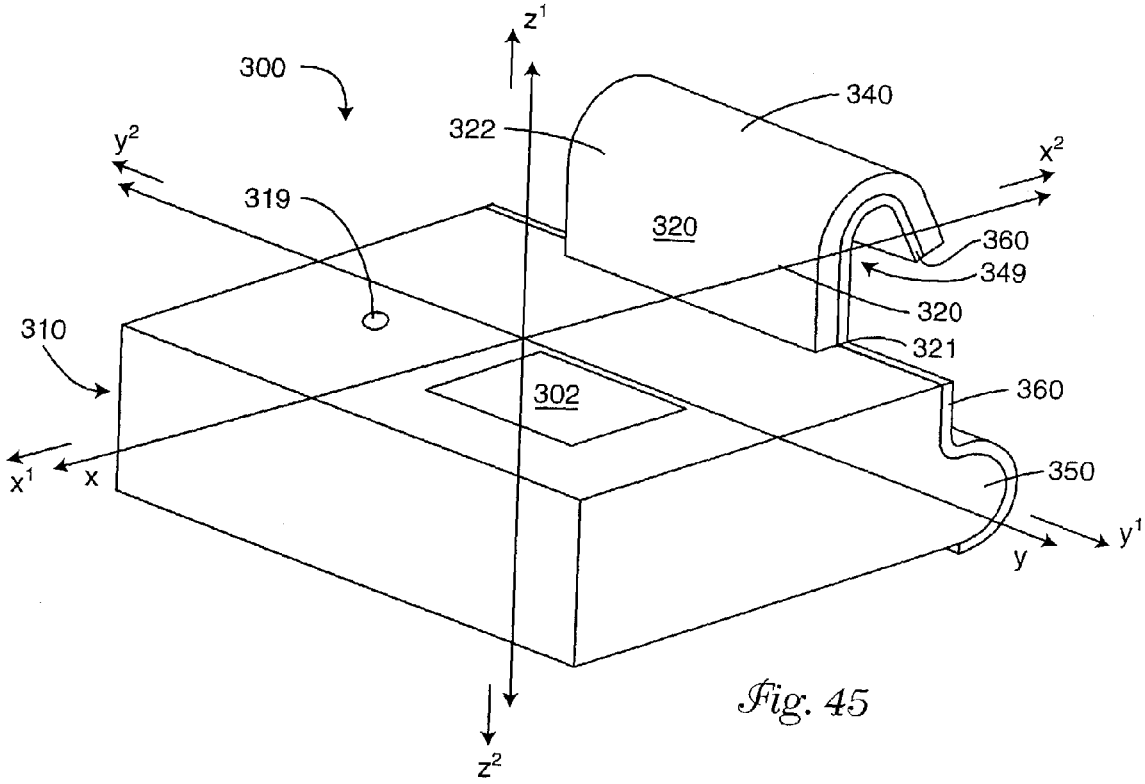

FIG. 45 is a front perspective view of a first aspect of a fourth embodiment of the invention.

Figure 46:
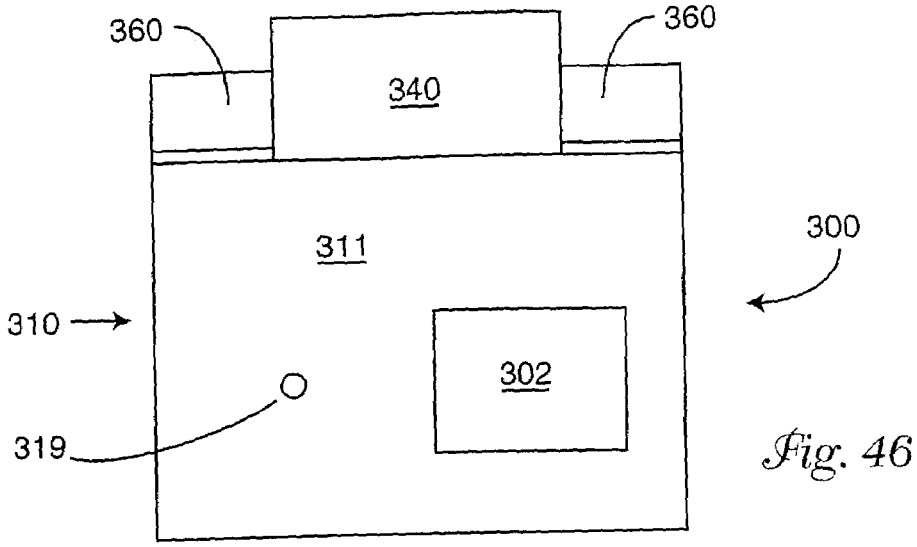

FIG. 46 is a top view of the invention shown in FIG. 45.

Figure 47:
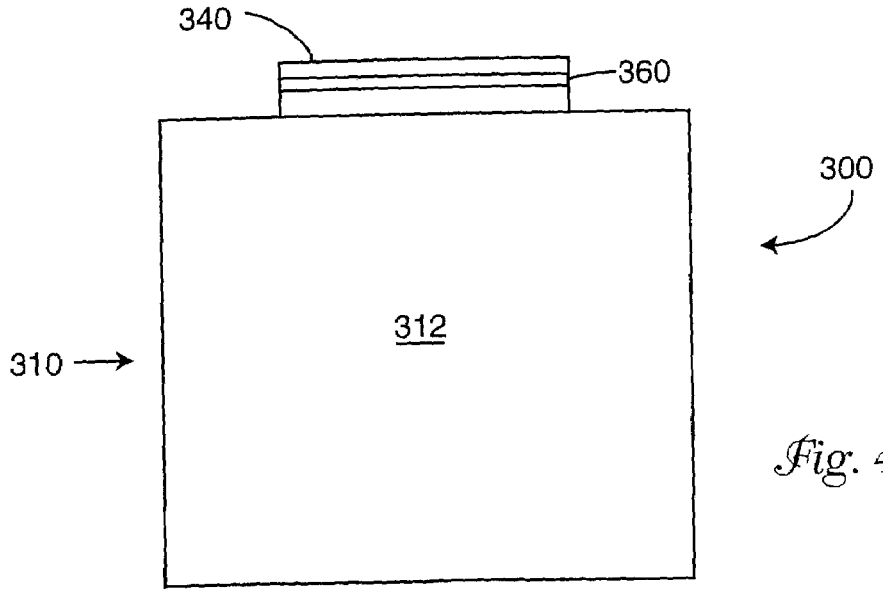

FIG. 47 is a bottom view of the invention shown in FIG. 45.

Figure 48:
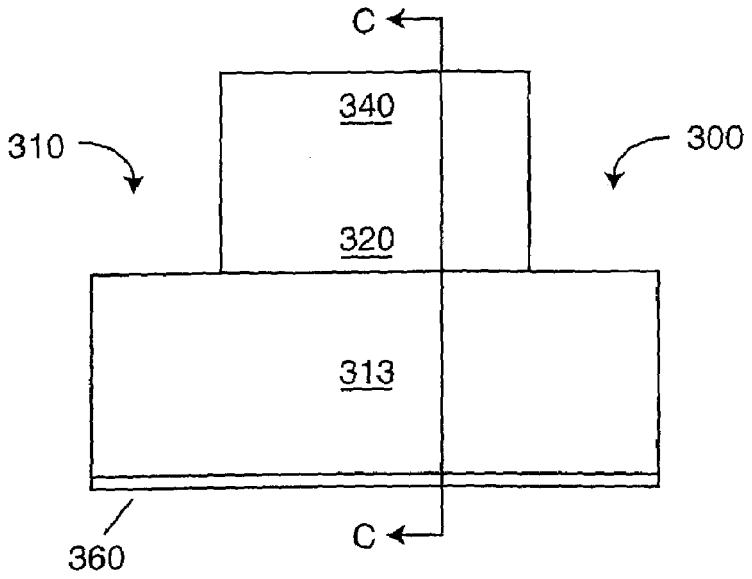

FIG. 48 is a front view of the invention shown in FIG. 45.

Figure 49:
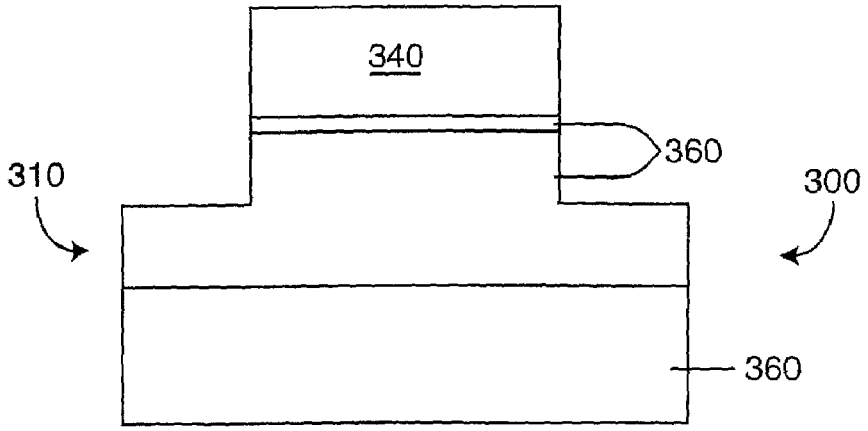

FIG. 49 is a back view of the invention shown in FIG. 45.

Figure 50:
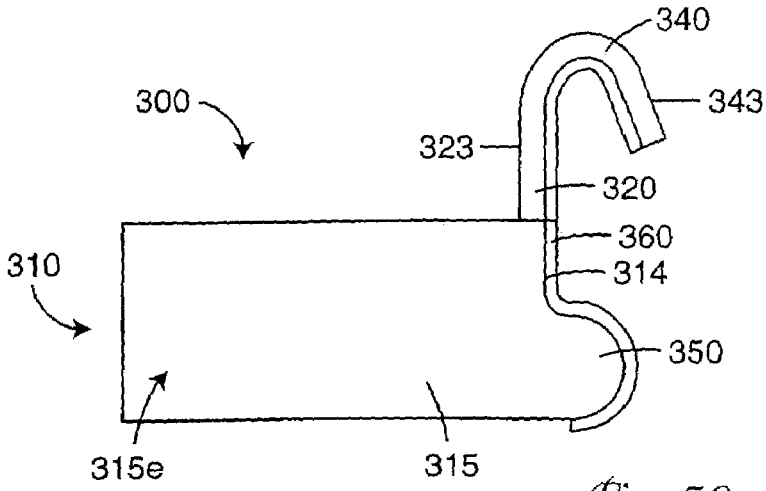

FIG. 50 is a right side view of the invention shown in FIG. 45.

Figure 51:
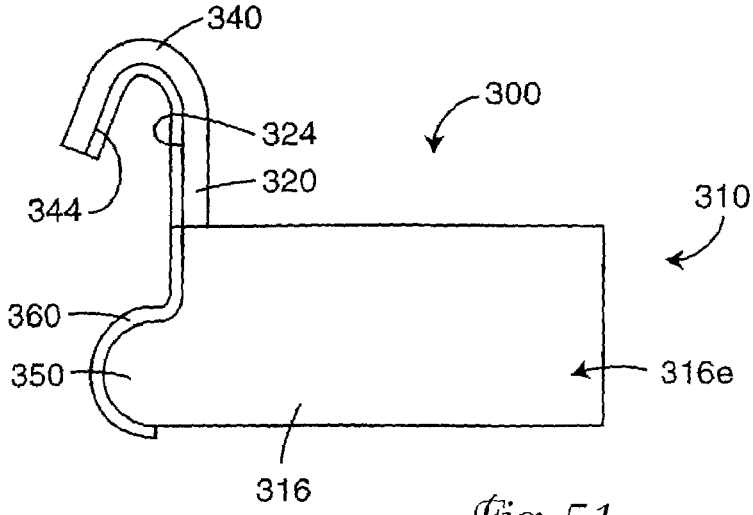

FIG. 51 is a left side view of the invention shown in FIG. 45.

Figure 52:
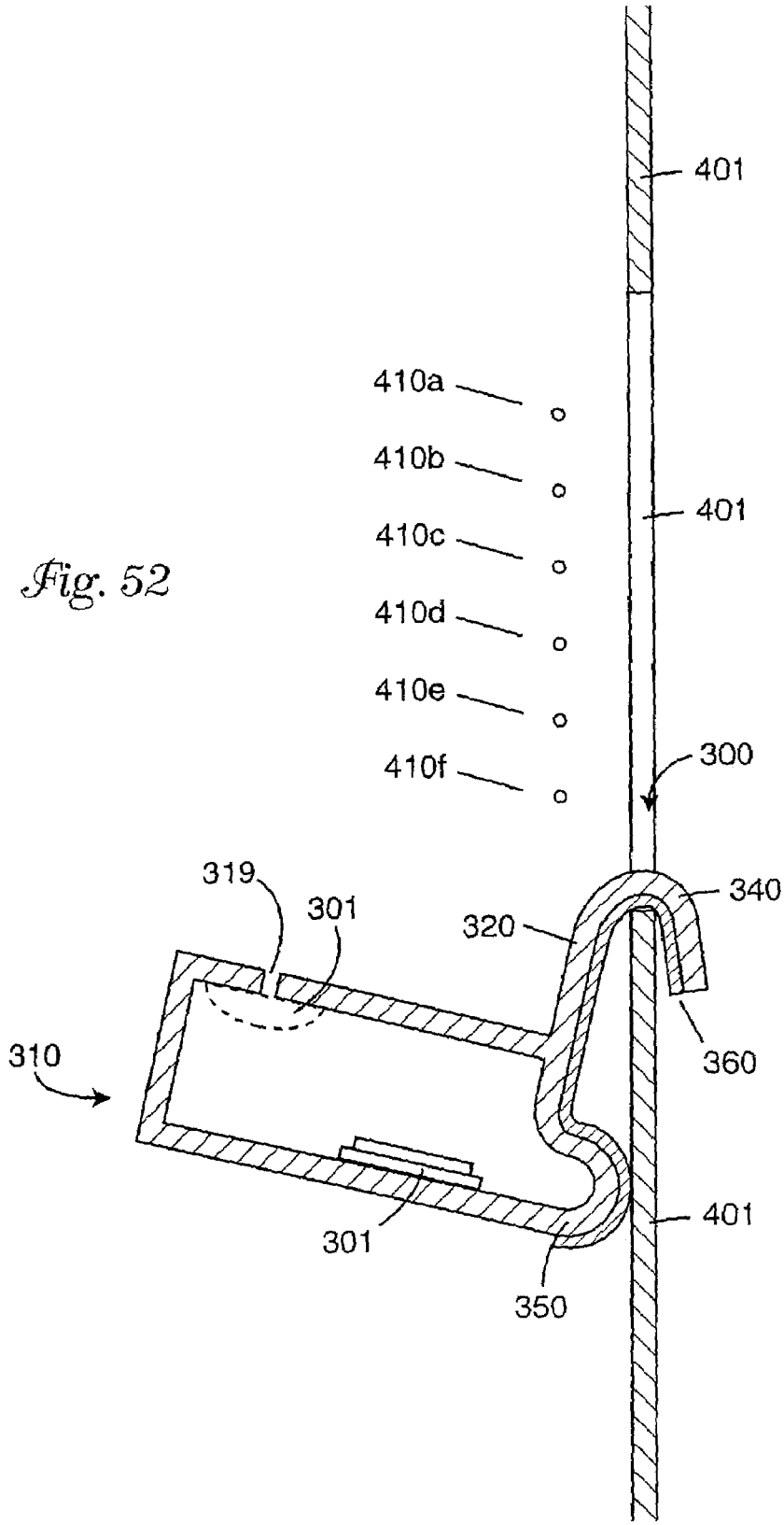

FIG. 52 is a cross-sectional right side view of the invention shown in FIG. 48 taken along line C—C suspended from the sound hole of a guitar.

Figure 53:
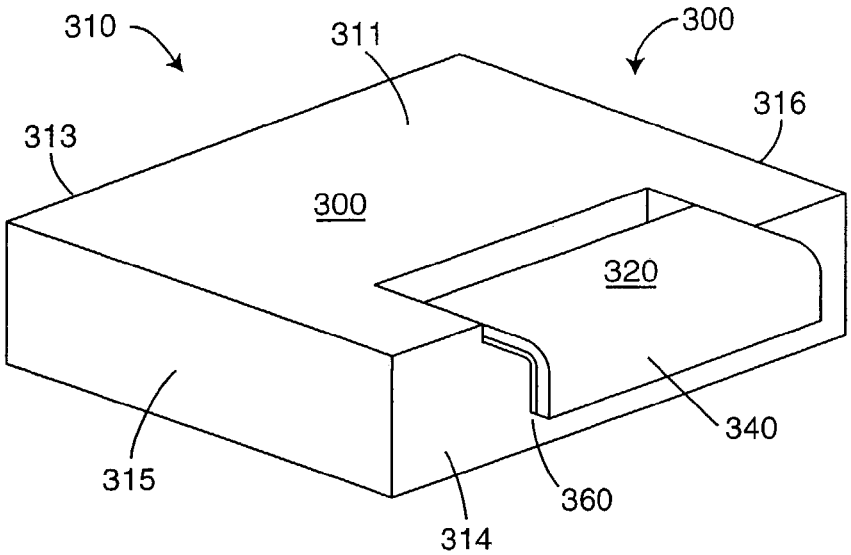

FIG. 53 is a front perspective view of a second aspect of the fourth embodiment of the invention having a slidable hook with the hook slid into the tuning position.

Figure 54:
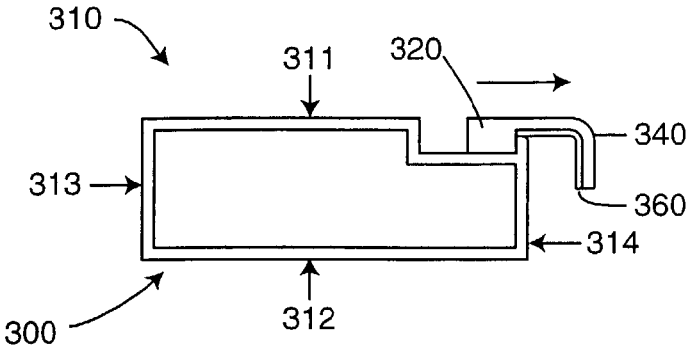

FIG. 54 is a side view of the invention shown in FIG. 53 with the hook slid into the tuning position.

Figure 55:
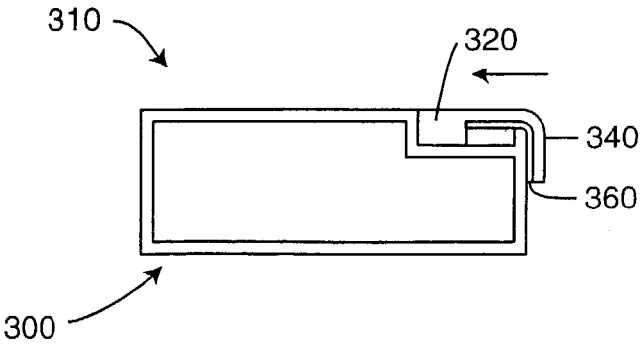

FIG. 55 is a side view of the invention shown in FIG. 53 with the hook slid into the storage position.

Figure 56:
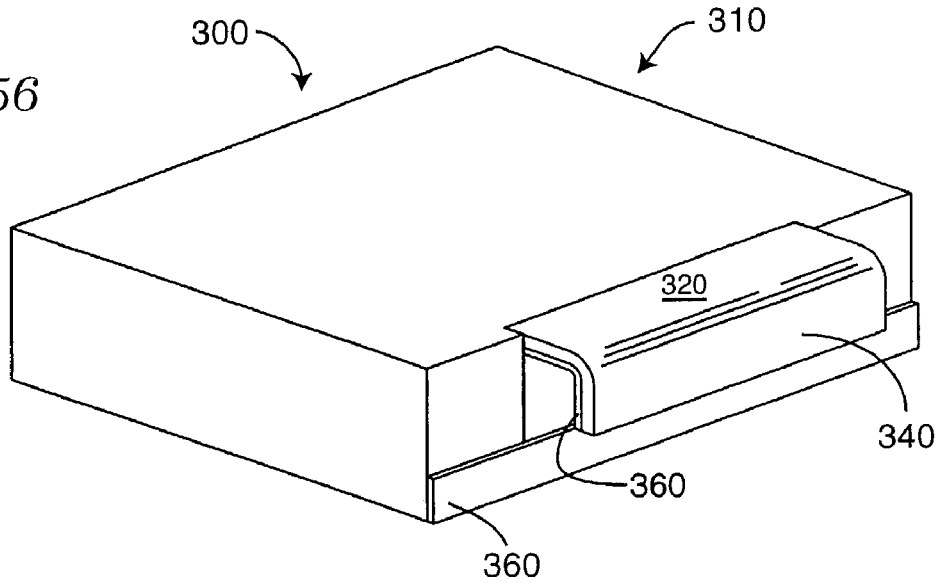

FIG. 56 is a rear perspective view of a third aspect of the fourth embodiment of the invention having a pivotable hook with the hook pivoted into the tuning position.

Figure 57:
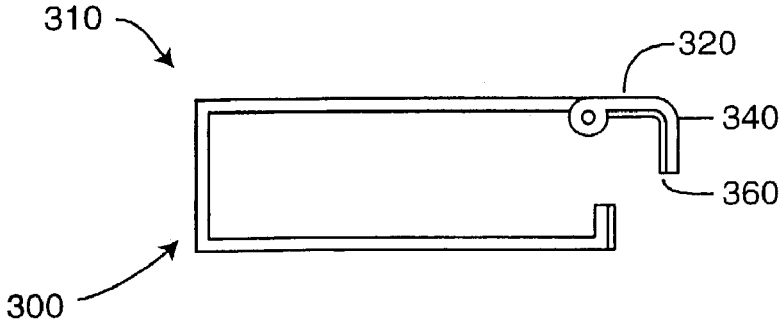

FIG. 57 is a side view of the invention shown in FIG. 56 with the hook pivoted into the tuning position.

Figure 58:
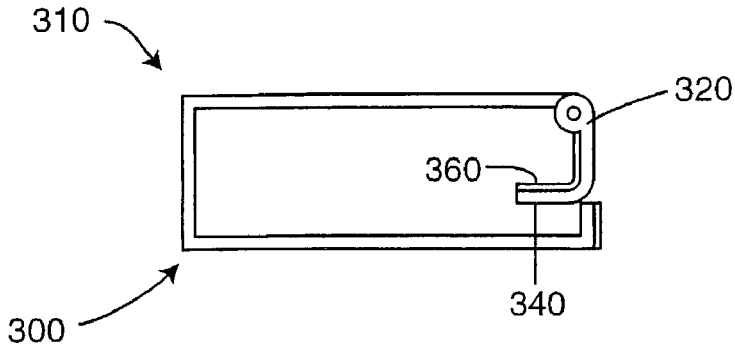

FIG. 58 is a side view of the invention shown in FIG. 56 with the hook pivoted into the storage position.

DETAILED DESCRIPTION OF THE INVENTION INCLUDING A BEST MODE

Nomenclature

First Embodiment

10 Holder
20 Strut
21 Distal Edge of Strut
22 Proximal Edge of Strut
23 First Major Surface of Strut
24 Second Major Surface of Strut
30 Shelf
30*y* Lateral Pivot Axis
31 Distal Edge of Shelf
32 Proximal Edge of Shelf
33 First Major Surface of Shelf
34 Second Major Surface of Shelf
39 Rotation Channel
40 Hook

43 Exterior Major Surface of Hook
44 Interior Major Surface of Hook
49 Concavity Defined by Hook
50 Protuberance
60 Protective Padding
70 Securing Means
71 Hook and Loop Tape
71*a* First Portion of Hook and Loop Tape
71*b* Second Portion of Hook and Loop Tape
71*r* Release Liner Over Adhesive Coating on Loop Portion of Hook and Loop Tape
80 Retaining Wall
81 Distal Edge of Retaining Wall
82 Proximal Edge of Retaining Wall
83 First Finger
84 Second Finger
89 Retention Channel
90 Transducer
91 Electrical Contact
92 Electrical Leads Second Embodiment

100 Holder
110 Enclosure
111 Front of Enclosure
112 Back of Enclosure
112*a* Interior Major Surface of Back of Enclosure
112*b* Exterior Major Surface of Back of Enclosure
113 Top of Enclosure
114 Bottom of Enclosure
114*a* Interior Major Surface of Bottom of Enclosure
114*b* Exterior Major Surface of Bottom of Enclosure
115 Right Side of Enclosure
116 Left Side of Enclosure
117' First Access Opening Through Top of Enclosure
117" Second Access Opening Through Front of Enclosure
118 Transverse Slot Through Front of Enclosure
119 Retention Chamber
140 Hook
143 Exterior Major Surface of Hook
144 Interior Major Surface of Hook
149 Concavity Defined by Hook
150 Protuberance
160 Protective Padding
190 Transducer
191 Electrical Contacts
192 Electrical Leads Third Embodiment

210 Holder
220 Strut
220*c* Central Wall of Strut
220*r* Right Sidewall of Strut
220*s* Left Sidewall of Strut
221 Distal Edge of Strut
222 Proximal Edge of Strut
223 First Major Surface of Central Wall of Strut
224 Second Major Surface of Central Wall of Strut
230 Connection Element
230*y* Lateral Pivot Axis
231 Distal Edge of Connection Element
232 Proximal Edge of Connection Element
239 Holding Channel
240 Hook
243 Exterior Major Surface of Hook
244 Interior Major Surface of Hook
249 Concavity Defined by Hook
250 Protuberance
260 Protective Padding
270 Securing Means
281 Laterally Extending Pin
282 Orifice
283 Rib
284 Slots
290 Transducer
291 Electrical Contact
292 Electrical Leads Fourth Embodiment

300 Tuner
301 Transducer in Tuner
302 Visual Tuning Display
310 Housing of Tuner
311 Front Wall of Tuner Housing
311*e* Exterior Surface of Front Wall of Tuner Housing
312 Back Wall of Tuner Housing
312*e* Exterior Surface of Back Wall of Tuner Housing
313 Top Wall of Tuner Housing
313*e* Exterior Surface of Top Wall of Tuner Housing
314 Bottom Wall of Tuner Housing
314*e* Exterior Surface of Bottom Wall of Tuner Housing
315 Right Side Wall of Tuner Housing
315*e* Exterior Surface of Right Side Wall of Tuner Housing
316 Left Side Wall of Tuner Housing
316*e* Exterior Surface of Left Side Wall of Tuner Housing
319 Transducer Sound Opening Through Housing
320 Strut
321 Distal Edge of Strut
322 Proximal Edge of Strut
323 First Major Surface of Strut
324 Second Major Surface of Strut
340 Hook
343 Exterior Major Surface of Hook
344 Interior Major Surface of Hook
349 Concavity Defined by Hook
350 Protuberance
360 Protective Padding Guitar

400 Guitar
401 Guitar Body
402 Sound Hole in Guitar
410*a* Guitar String
410*b* Guitar String
410*c* Guitar String
410*d* Guitar String
410*e* Guitar String
410*f* Guitar String Tuner

500 Tuner
501 Transducer in Tuner
502 Visual Tuning Display
510 Housing of Tuner
511 Front Face of Tuner
512 Back Face of Tuner
517 Input Port
519 Transducer Sound Opening Through Housing Spatial Axes and Directions x Longitudinal Axis
$x^1$ First Longitudinal Direction
$x^2$ Second Longitudinal Direction
y Latitudinal Axis
$y^1$ First Latitudinal Direction
$y^2$ Second Latitudinal Direction
z Transverse Axis
$z^1$ First Transverse Direction
$z^2$ Second Transverse Direction Definitions As utilized herein, including the claims, the term "playing" means to pluck, strike or stroke a string on a stringed instrument so as to cause the string to vibrate.

As utilized herein, including the claims, the phrase "major portion," means at least 80%.

As utilized herein, including the claims, the phrase "minor portion," means less than 40%.

As utilized herein, including the claims, the phrase "substantially perpendicular," means forming an angle $\alpha$ of between 80° and 100° (i.e., within 100° of perpendicular).

As utilized herein, including the claims, the phrase "protective padding," means a material effective for protecting the surface finish of a stringed instrument from scuffmarks, abrasions, and scratches.

As utilized herein, including the claims, the term "transducer," means a component capable of sensing and converting mechanical or acoustical signals (i.e., pressure waves) into electrical signals.

As utilized herein, including the claims, the term "vibration," is used generically and encompasses the vibration of solids (e.g., a guitar string or guitar body), liquids (e.g., water), and gasses (e.g., air). Accordingly, vibration encompasses oscillations which can be sensed audibly or tactilely.

Construction

The invention is suitable for use in connection with a wide variety of stringed instruments so long as the instrument has a sound hole from which the invention may be suspended, including specifically, but not exclusively, dulcimers, guitars, harps, mandolins, and ukuleles. Since the invention is particularly suited for use in connection with guitars, the balance of the disclosure shall be based upon use of the invention in connection with the tuning of a guitar, without any intent to limit the claims to guitar tuners or the tuning of guitars.

First Embodiment

Referring generally to FIGS. 1–13, a first embodiment of the invention is a guitar tuner holder 10, which includes a strut 20, a shelf 30, and a hook 40.

The strut 20 extends in a transverse direction z with a distal edge 21 transversely spaced in a second transverse direction $z^2$ from a proximal edge 22. The strut 20 may be sized, shaped and configured as desired so long as the strut 20 extends in a transverse direction z, is capable of securely supporting a tuner 500 placed upon the shelf 30, and capable of withstanding normal wear and tear. Acceptable configurations of the strut 20 include specifically but not exclusively, a rectangular plane, a triangular plane, an ornamentally shaped plane, a framework of stiles and rails, an ornamental framework, a single central beam, a Y-shaped split beam, etc.

The strut 20 preferably has a transverse height of 2 to 5 cm and a lateral width of 1 to 10 cm.

In a preferred embodiment, the strut 20 defines a first major surface 23 facing a first longitudinal direction $x^1$ and a second major surface 24 facing a second longitudinal direction $x^2$.

The shelf 30 extends substantially perpendicular in the first longitudinal direction $x^1$ from the distal edge 31 of the strut 20, with a proximal edge 32 of the shelf 30 connected directly or indirectly to the distal edge 21 of the strut 20 and a distal edge 31 of the shelf 30 longitudinally spaced from the proximal edge 32 of the shelf in the first longitudinal direction $x^1$. The shelf 30 may be sized, shaped and configured as desired so long as the shelf 30 extends in a first longitudinal direction $x^1$ from the strut 20, is capable of securely supporting a tuner 500 placed upon the shelf 30, and possesses a structural integrity sufficient to withstand normal wear and tear. Acceptable configurations of the shelf 30 include specifically but not exclusively, a rectangular plane, a triangular plane, an ornamentally shaped plane, a framework of stiles and rails, an ornamental framework, a Y-shaped split beam, etc.

The shelf 30 preferably has a lateral width of 1 to 10 cm and a longitudinal depth of 3 to 10 cm.

In a preferred embodiment, the shelf 30 defines a first major surface 33 facing a first transverse direction $z^1$ and a second major surface 34 facing a second transverse direction $z^2$.

The hook 40 extends in a second longitudinal direction $x^2$ from the proximal edge 22 of the strut 20 and defines a concavity 49 open towards the distal edge 21 of the strut 20 (i.e., accessible in a first transverse direction $z^1$). The hook 40 is preferably laterally elongated so as to provide at least two laterally spaced points of contact (unnumbered) between the hook 40 and a guitar body 401 when the holder 10 is suspended from the sound hole 402 of the guitar 400 so as to increase the lateral direction y stability of the suspended holder 10.

The hook 40 preferably has a lateral width of 2 to 5 cm and a longitudinal depth of 1 to 2 cm.

The longitudinal depth of the concavity 49 defined by the hook 40 is preferably greater than the thickness of a standard guitar body 401 at the sound hole 402 in order to simplify hooking of the holder 10 onto a guitar body 401 and prevent the exertion of any clamping force upon a guitar body 401 by the hook 40 which could result in damage to the surface finish of the guitar body 401. Due to the oversized nature of the concavity 49, the holder 10 will tend to "lean" forward from a guitar body 401 when the holder 10 is suspended from the sound hole 402 of the guitar 400, causing the shelf 30 to extend at a slight downward angle relative to a guitar body 401 (i.e., the first major surface 33 of the shelf 30 forms an angle of slightly more than 90° (e.g., commonly between about 100° to 120°) with the face (unnumbered) of the guitar body 401). In order to return this angle closer to 90°, the holder 10 preferably includes a protuberance 50 which extends in the second longitudinal direction $x^2$ from proximate the distal edge 21 of the strut 20. In a preferred aspect, the protuberance 50 extends a distance in the second longitudinal direction $x^2$ sufficient for causing the shelf 30 to extend at a slight upward angle relative to a guitar body 401 when the holder 10 is suspended from the sound hole 402 of the guitar 400 (i.e., the first major surface 33 of the shelf 30 forms an angle of slightly less than 90° (e.g., between about 70° to 80°) with the face (unnumbered) of the guitar body 401). By causing the shelf 30 to extend at a slight upward angle from the guitar body 401, the transducer 501, typically a microphone, and transducer sound opening 519 in a tuner 500 supported by the holder 10 will more directly face the guitar strings 410*a–f* and sound hole 402 of the guitar 400 and thereby improve the reception of sound emanating from the guitar 400 by the transducer 501, while also causing the visual tuning display 502 on the tuner 500 to more directly face the person (not shown) holding and tuning the guitar 400 and thereby facilitate viewing of the visual tuning display 502 during tuning of the guitar 400.

The protuberance 50 may be a single bump centered laterally on the strut 20, a pair of laterally spaced bumps, a plurality of laterally and transversely spaced bumps, a laterally elongated ridge, or any number of other structures effective for achieving the desired angling of the shelf 30.

The protuberance 50 preferably has a longitudinal depth of 0.3 to 1 cm.

The holder 10 preferably includes a securing means 70 for securing a tuner 500 to the holder 10. As shown in FIGS. 7 through 11, an exemplary means 70 for securing a tuner 500 to the holder 10 is hook and loop tape 71. The hook and loop tape 71 includes (i) a first portion 71*a* (i.e., either the hook portion or the loop portion) adhesively bonded to the holder 10, (ii) a second portion 71*b* (i.e., the hook portion or loop portion which is complimentary to the first portion 71*a*) which is releasably attached by the connective effect of the hook and loop tape 71 to the first portion 71*a*, and (iii) a release liner 71*r* covering the pressure sensitive adhesive coated exposed major surface (unnumbered) of the second portion 71*b*.

The release liner 71*r* can be removed for subsequent adhesive attachment of the second portion 71*b* of the hook and loop tape 71 to a tuner 500.

The hook and loop tape 71 is preferably attached to the first major surface 23 of the strut 20 proximate the first major surface 33 of the shelf 30. Such a positioning of the hook and loop tape 71 allows a tuner 500 to be attached to the holder 10 by longitudinally sliding the tuner 500 along the first major surface 33 of the shelf 30 in the second longitudinal direction $x^2$ until the second portion 71*b* of the hook and loop tape 71 adhered to the tuner 500 contacts the complimentary first portion 71*a* of the hook and loop tape 71 adhered to the holder 10. Detachment of the tuner 500 can be achieved by holding the tuner 500 in one hand (not shown) and the holder 10 in the other (not shown) and then pulling the tuner 500 and holder 10 in opposite longitudinal directions $x^1$ and $x^2$ respectively.

Figure 1:
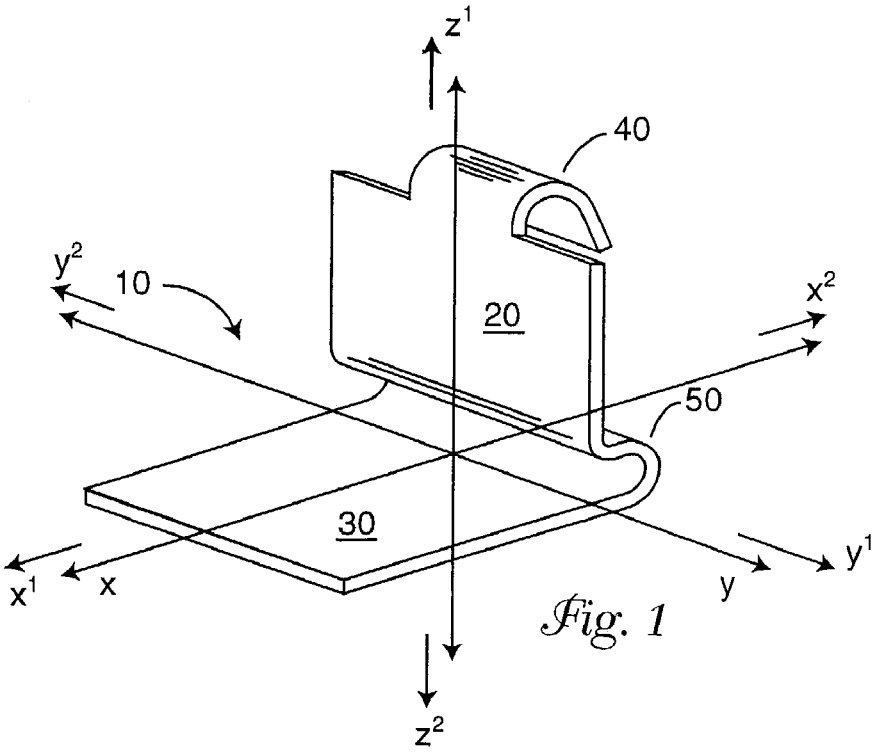
FIG. 1 is a front perspective view of a first aspect of a first embodiment of the invention.
Figure 2:
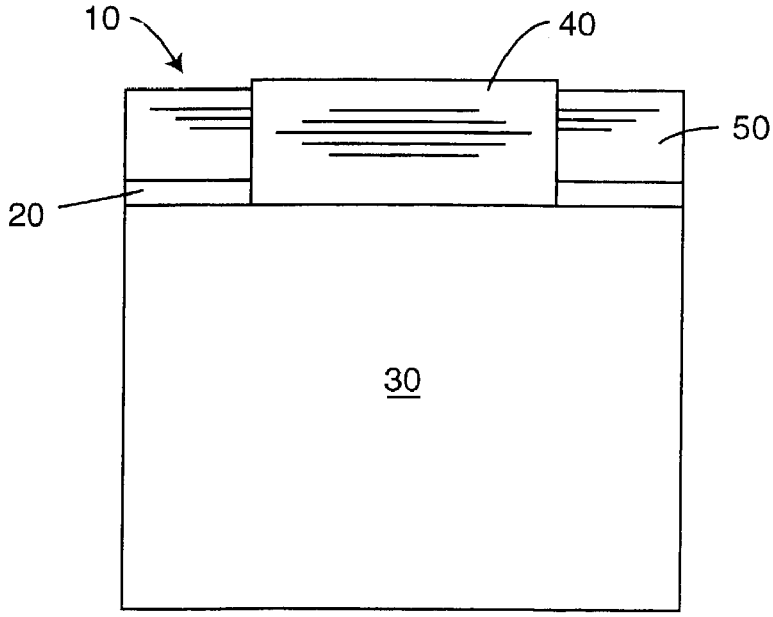
FIG. 2 is a top view of the invention shown in FIG. 1.
Figure 3:
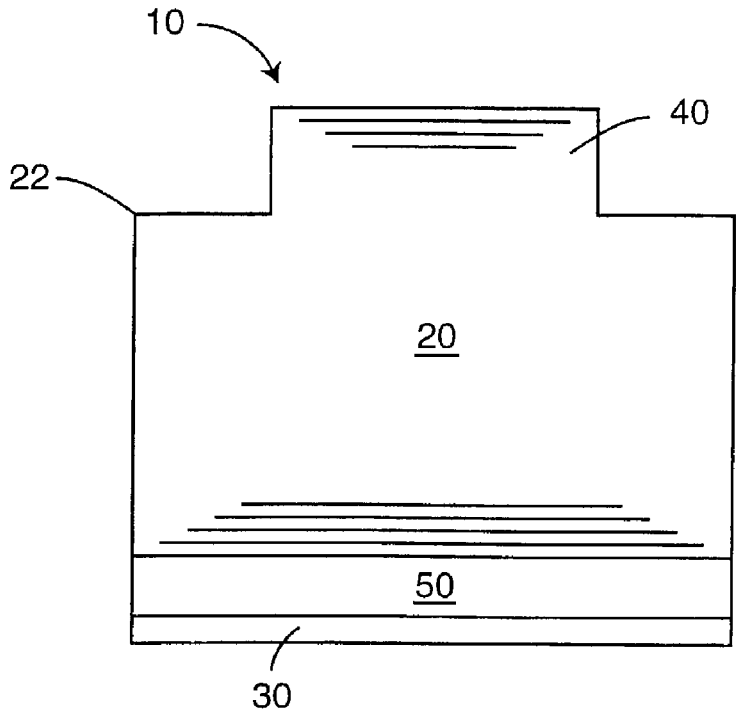
FIG. 3 is a front view of the invention shown in FIG. 1.
Figure 4:
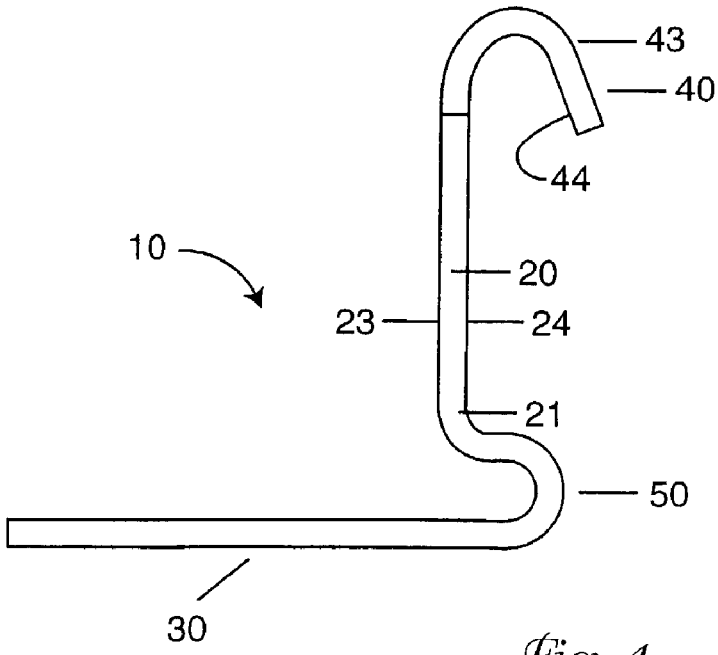
FIG. 4 is a right side view of the invention shown in FIG. 1.
Figure 5:
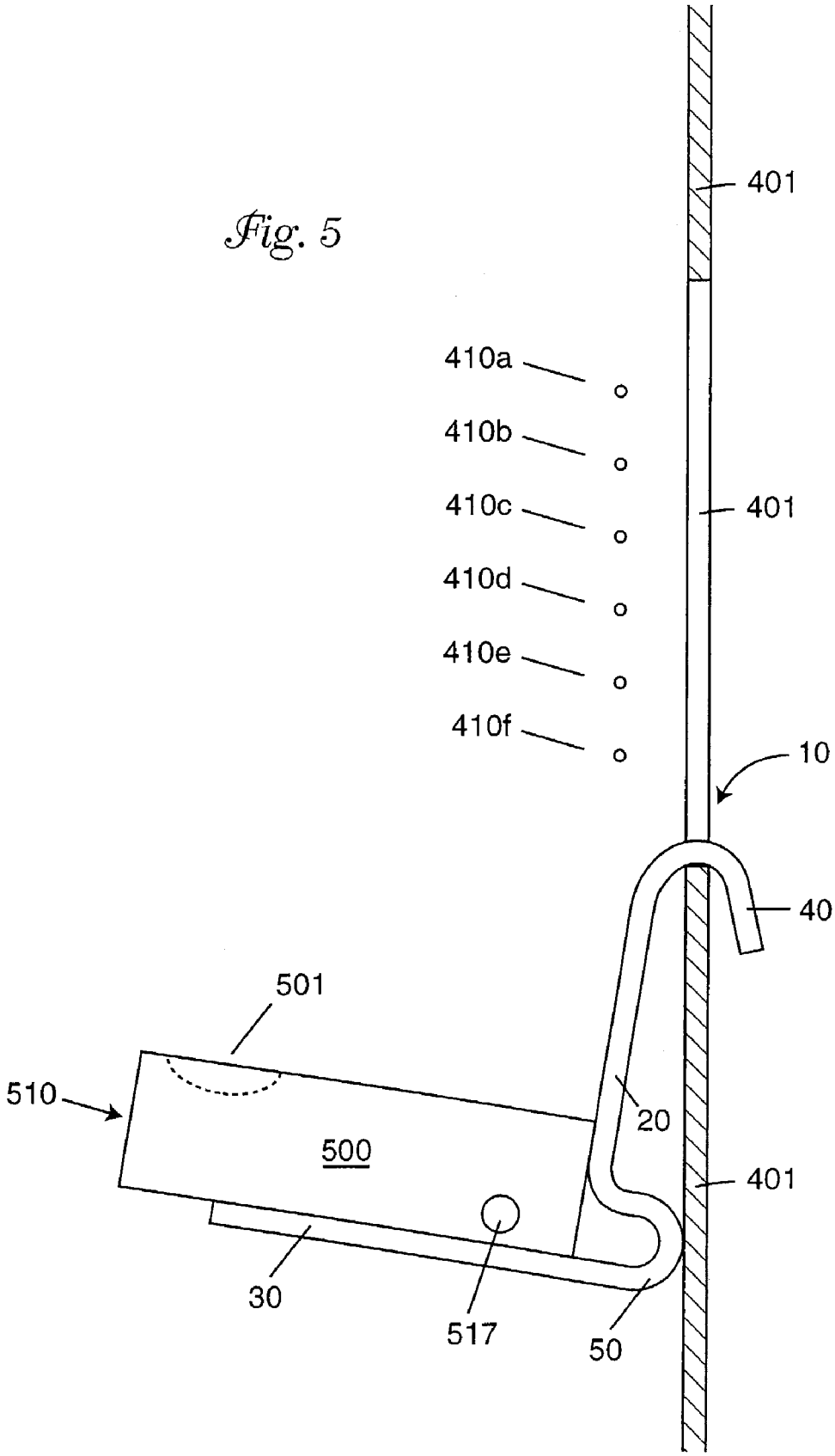
FIG. 5 is a right side view of the invention shown in FIG. 1 suspended from the sound hole of a guitar and holding a tuner.
Figure 6:
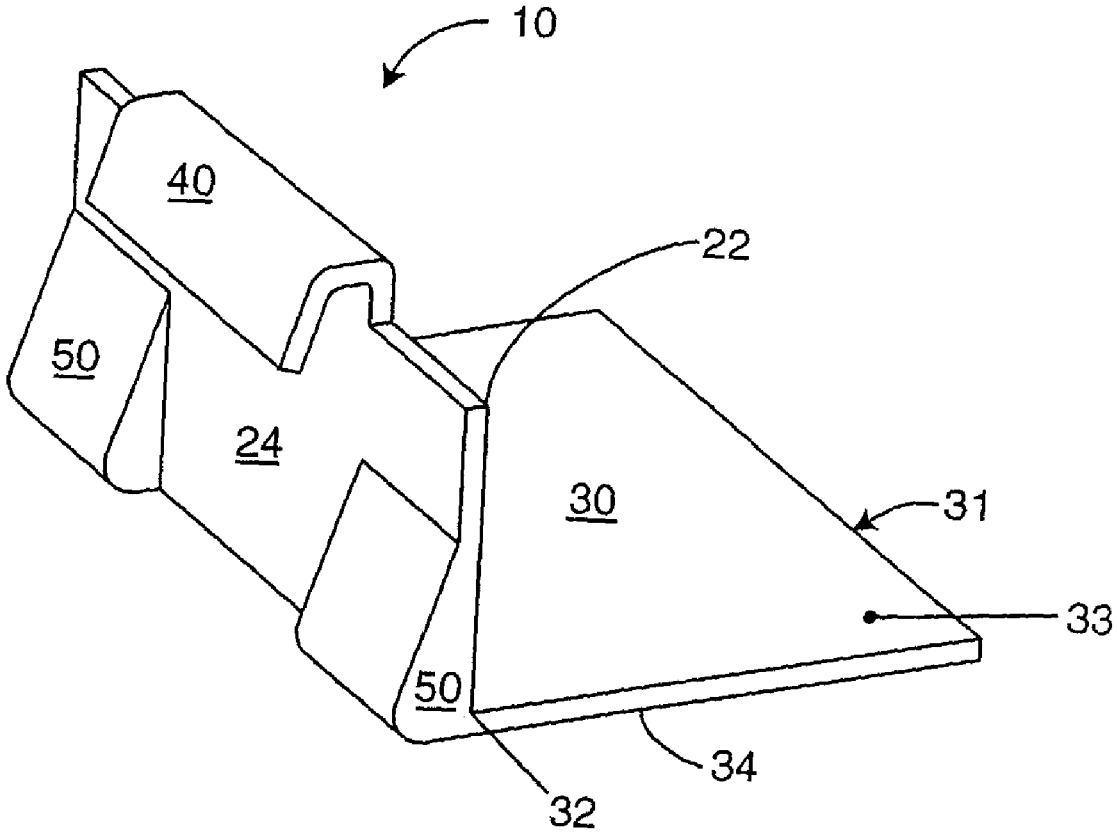
FIG. 6 is a rear perspective view of a second aspect of the first embodiment of the invention.
Figure 7:
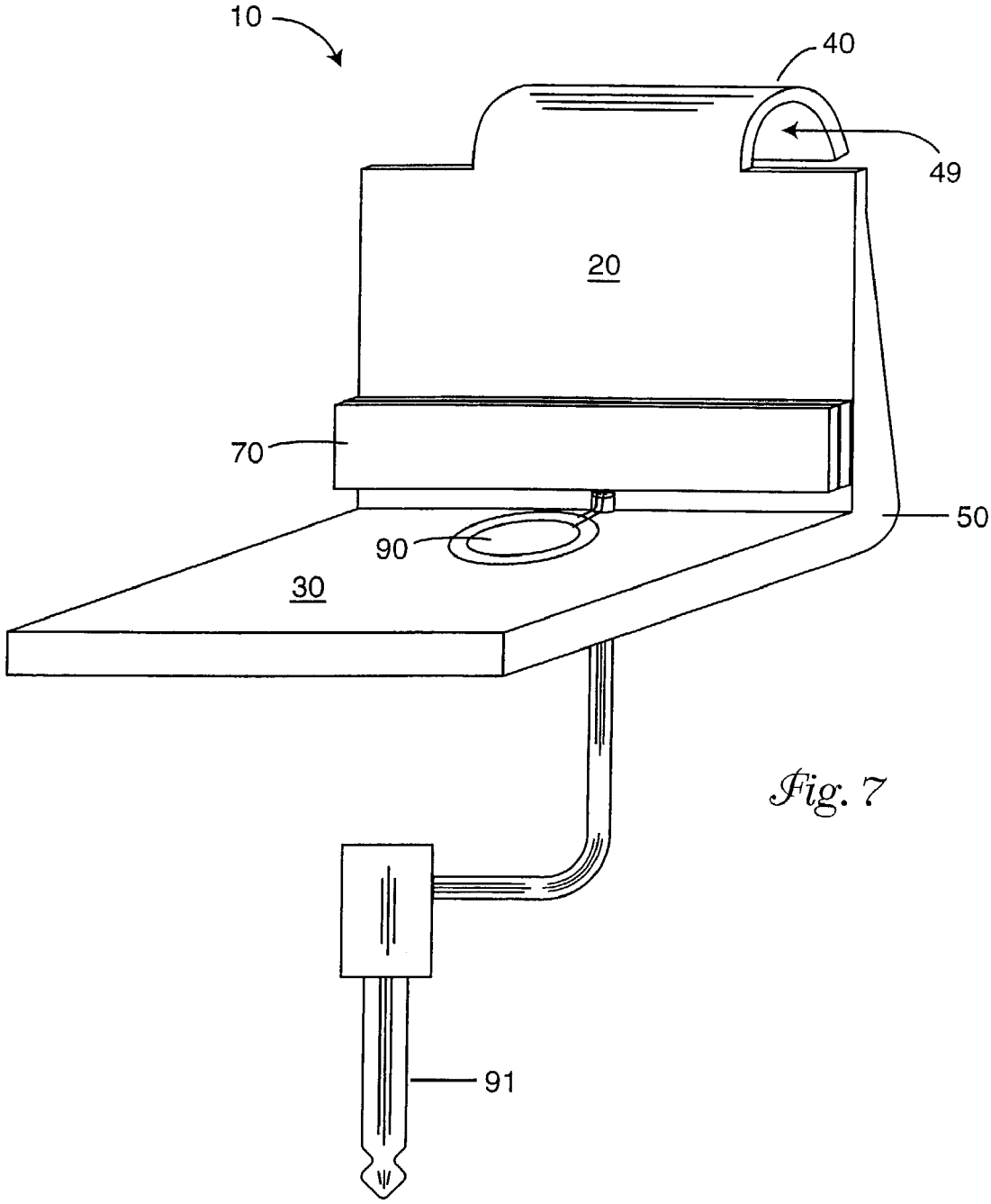
FIG. 7 is a front perspective view of a third aspect of the first embodiment of the invention.
Figure 8:
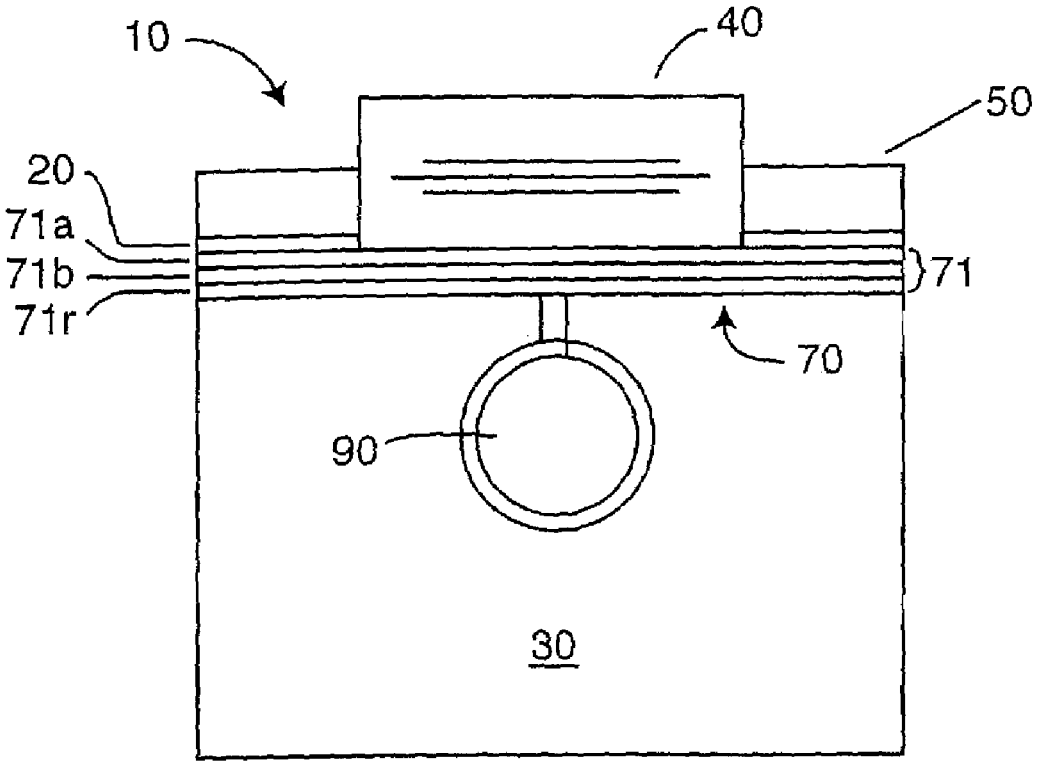
FIG. 8 is a top view of the invention shown in FIG. 7.
Figure 9:
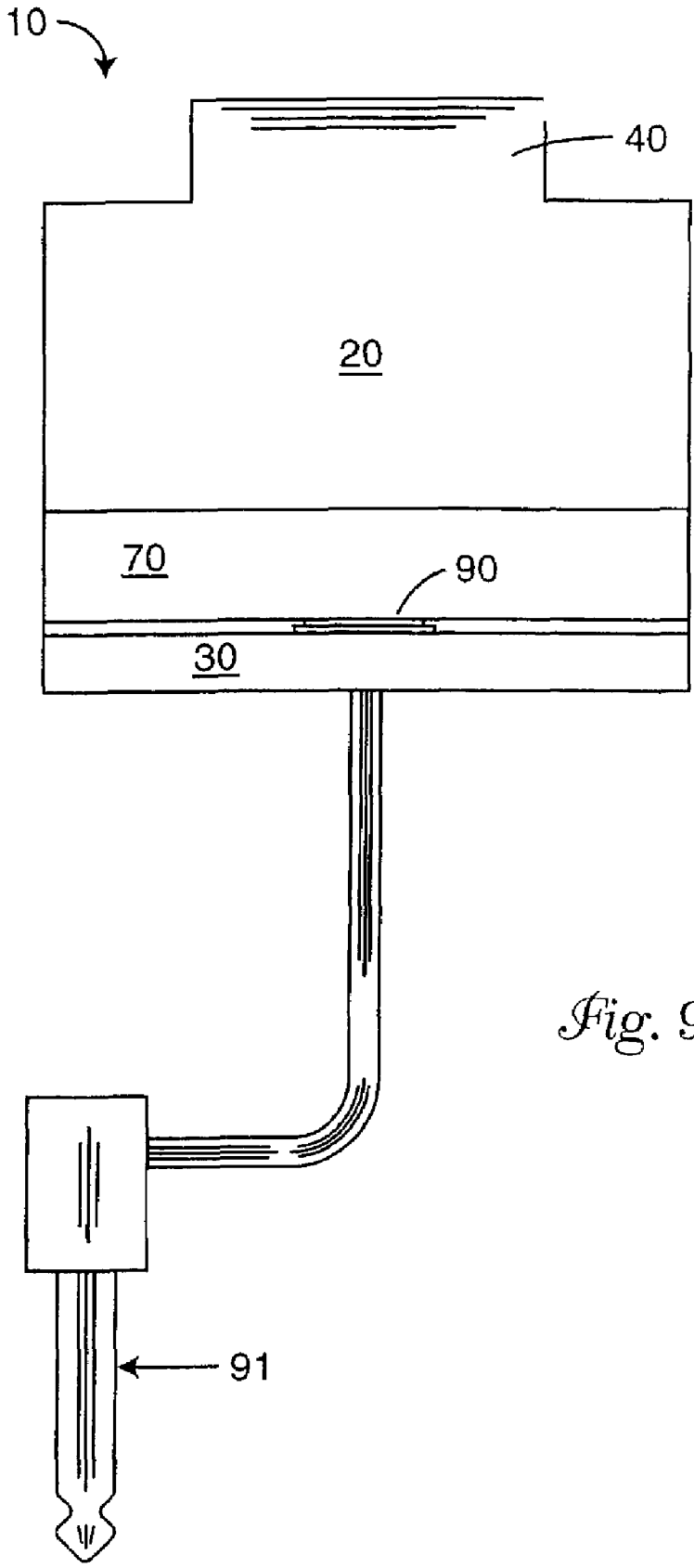
FIG. 9 is a front view of the invention shown in FIG. 7.
Figure 10:
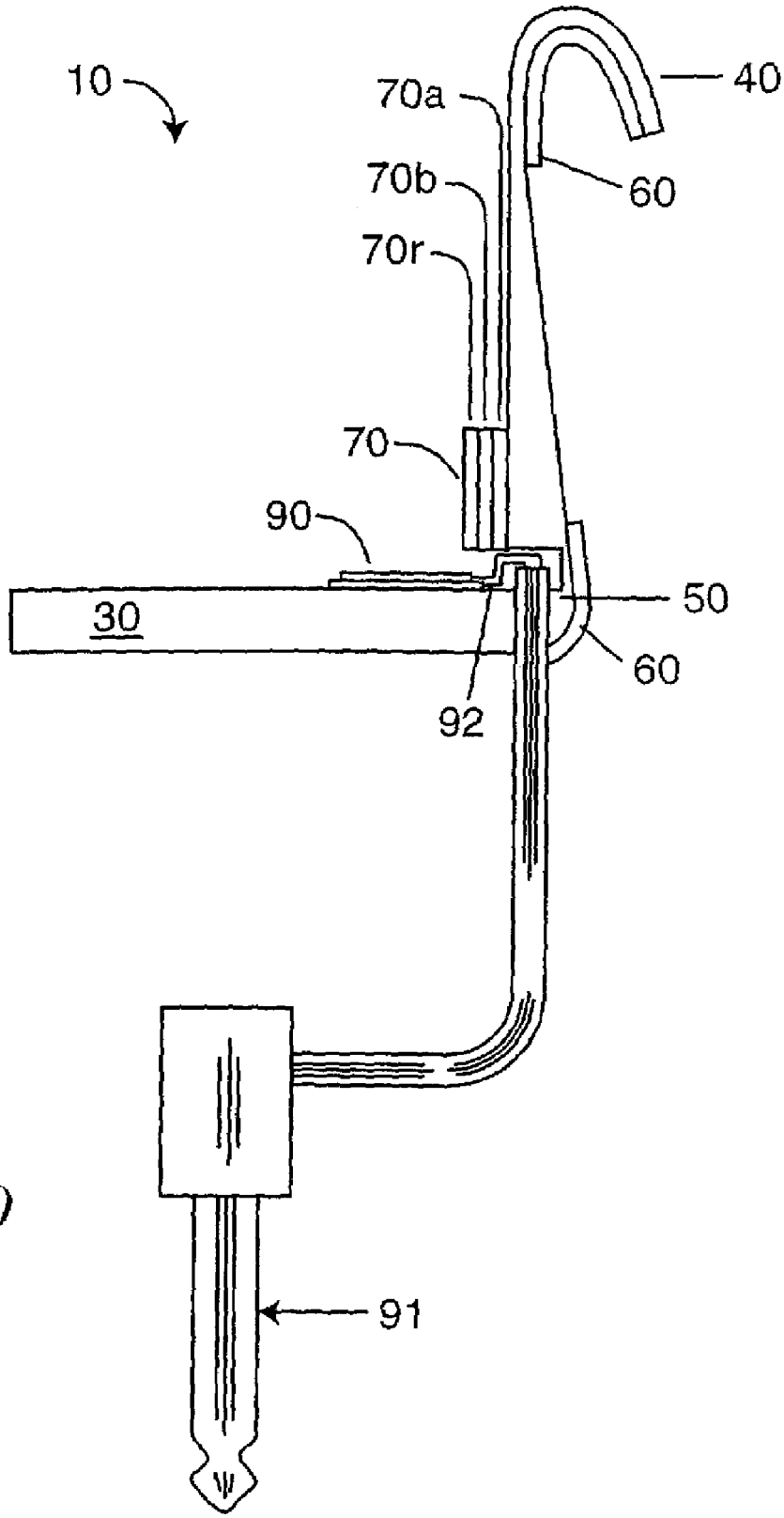
FIG. 10 is a right side view of the invention shown in FIG. 7.
Figure 11:
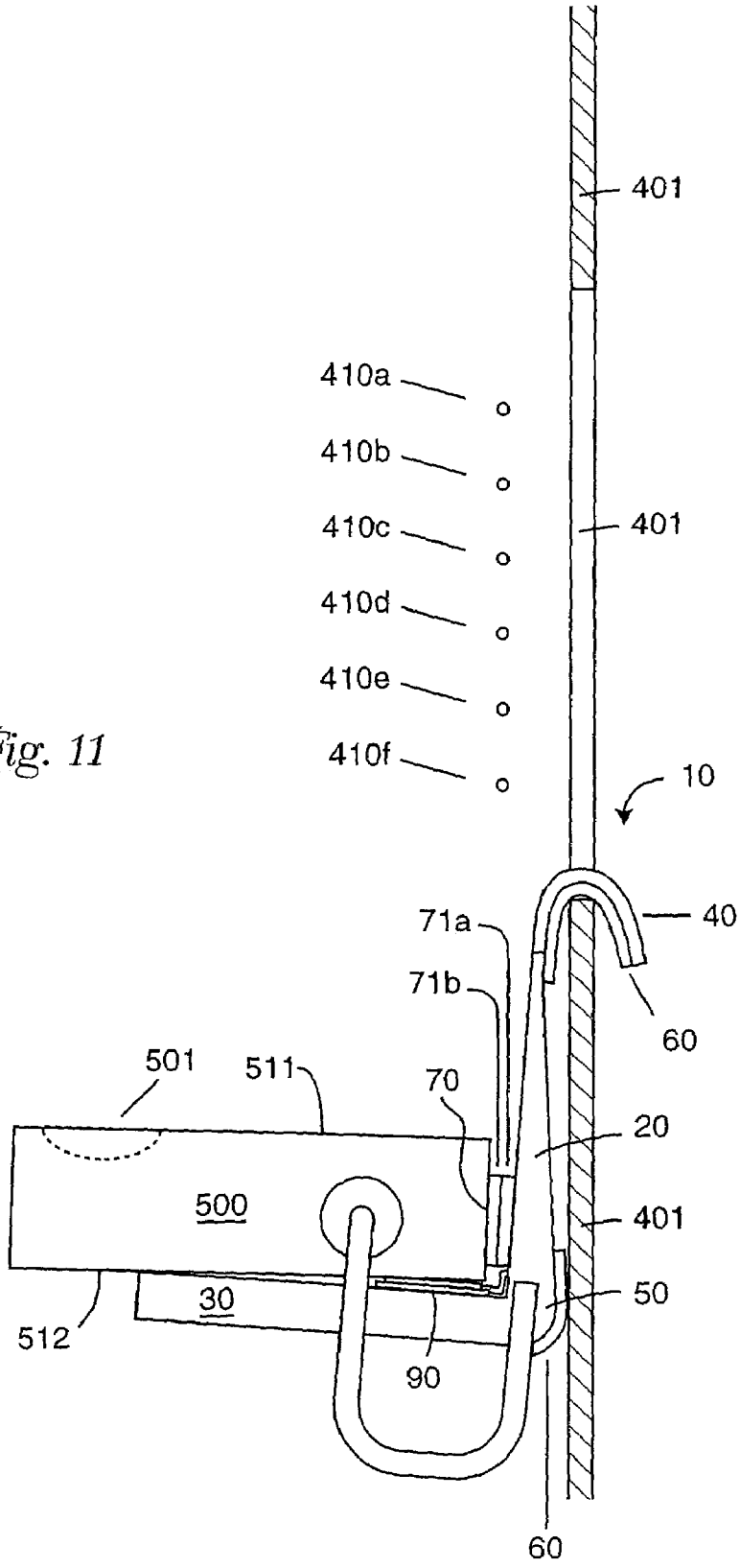
FIG. 11 is a right side view of the invention shown in FIG. 7 suspended from the sound hole of a guitar and holding a tuner which is electronically connected to the transducer.

As shown in FIGS. 8, 10 and 11, a layer of protective padding 60 is preferably placed over those portions of the holder 10 which contact the body 401 of a guitar 400 when the holder 10 is suspended from the guitar body 401 proximate the sound hole 402 in the guitar 400. The desired protection can generally be achieved by providing a layer of protective padding 60 over at least a portion of the second major surface 24 of the strut 20, at least a portion of the interior major surface 44 of the hook 40, and at least a portion of any protuberance 50 including at least the apex (unnumbered) of the protuberance 50. In order to maximize protection afforded by the protective padding 60, it is generally desired to provide a layer of protective padding 60 over the entire second major surface 24 of the strut 20, the entire second major surface 34 of the shelf 30, the entire interior major surface 44 of the hook 40, and the entire exposed surface area of any protuberance 50.

Figure 12:
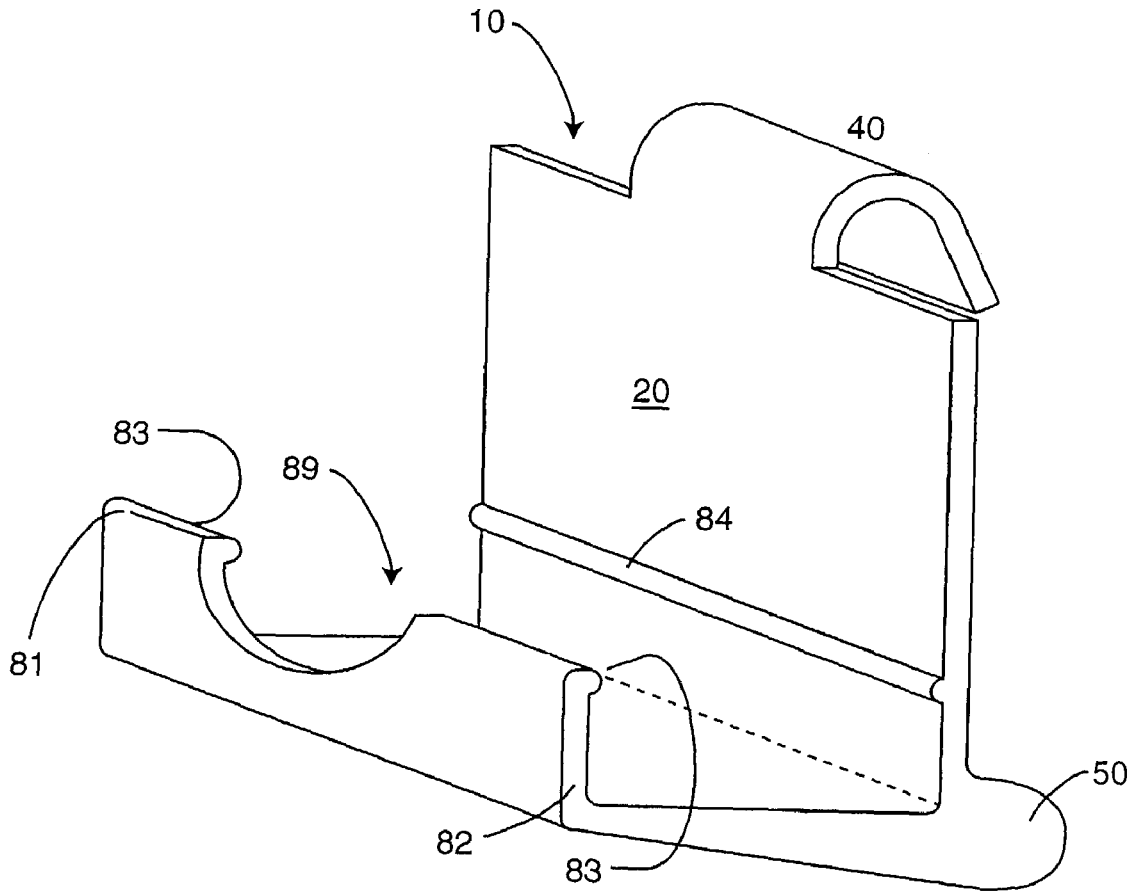
FIG. 12 is a front perspective view of a fourth aspect of the first embodiment of the invention.
Figure 13:
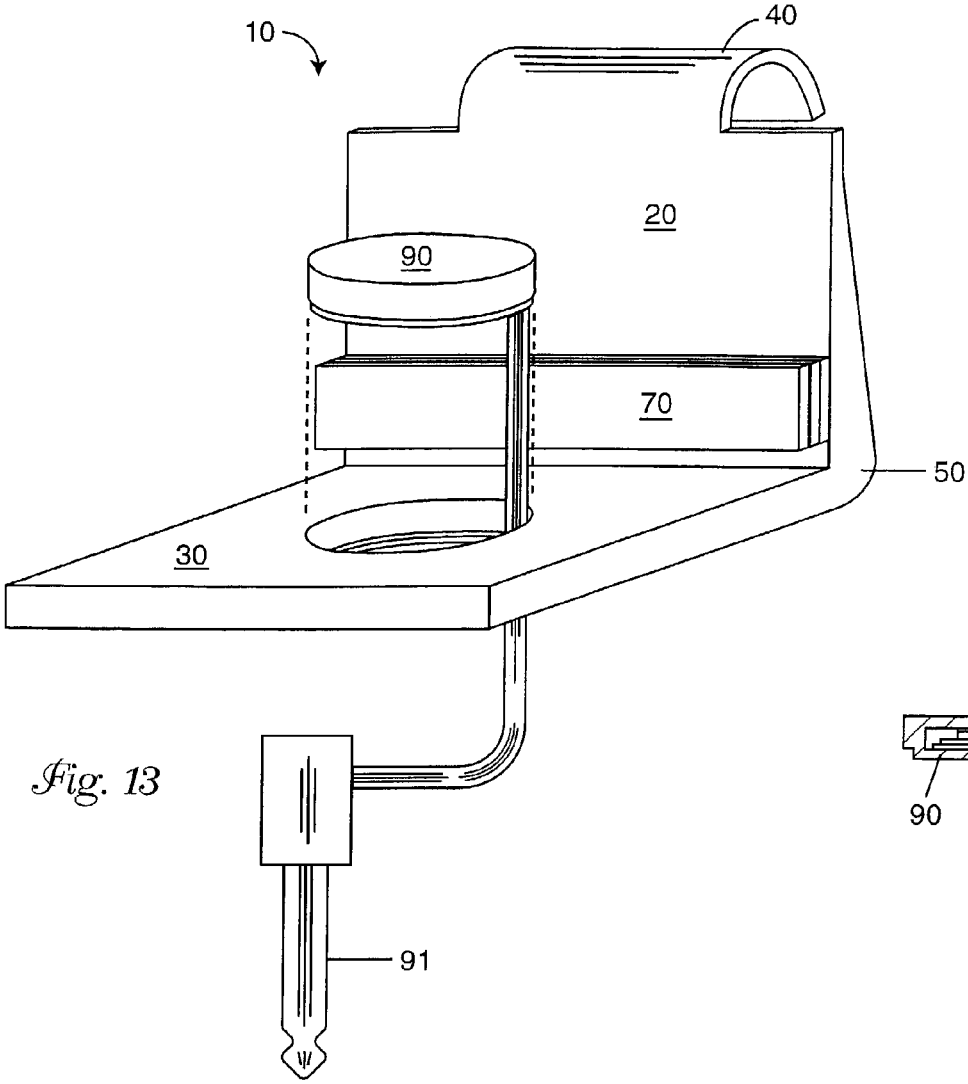
FIG. 13 is a front perspective view of a fifth aspect of the first embodiment of the invention.
Figure 13A:
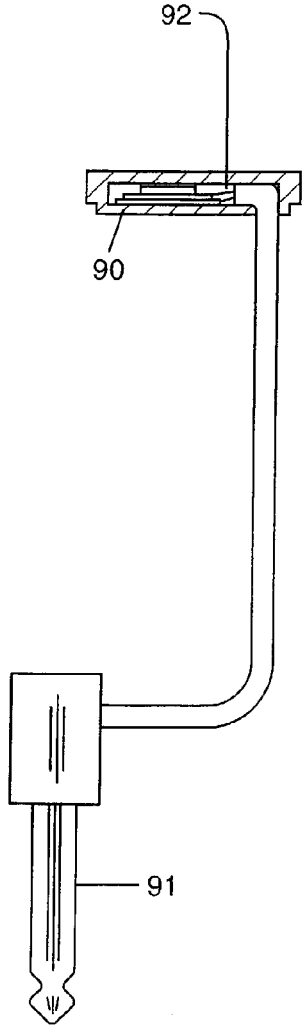
FIG. 13*a* is a front view of the transducer shown in FIG. 13 removed and separated from the holder with a portion of the casing removed to show the transducer.

Materials suitable for use as protective padding 60 include any material effective for protecting the surface finish of a guitar body 401 from scuff marks, abrasions and scratches include specifically, but not exclusively, felt, foamed thermoplastics, low durometer rubber, foamed rubber, etc. Selection of a suitable material for use as protective padding 60 is well within the competency of those having ordinary skill in the art. As shown in FIG. 12, the holder 10 may optionally include a retaining wall 80 extending in the first transverse direction $z^1$ from the shelf 30 proximate the distal edge 31 of the shelf 30 for forming a retention channel 89 with the strut 20 and shelf 30 effective for improving retention of a tuner 500 on the shelf 30 during tuning. The proximal edge 82 of the retaining wall 80 is coupled directly or indirectly to the shelf 30 with the distal edge 81 of the retaining wall 80 extending from the proximal edge 82 of the retaining wall 80 in the first transverse directions $z^1$.

When the holder 10 includes a retaining wall 80, holder 10 is preferably configured, arranged, and constructed from a material which allows the retaining wall 80 to be elastically deflected away from the strut 20 so that a tuner 500 may be (i) inserted into the retention channel 89 by deflection of the retaining wall 80 from a normally closed position nearer the strut 20 to an open position further from the strut 20 and dropping the tuner 500 into the open retention channel 89, (ii) retained within the retention channel 89 by allowing the deflected retaining wall 80 to return to the closed position, and (iii) removed from the retention channel 89 by deflection of the retaining wall 80 from the normally closed position nearer the strut 20 to the open position further from the strut 20 and lifting the tuner 500 from the open retention channel 89.

As shown in FIG. 12, retention of a tuner 500 within the retention channel 89 may be further enhanced by providing (i) a first longitudinally extending ridge or finger 83 proximate the distal edge 81 of the retaining wall 80 which extends in the second longitudinal direction $x^2$ into or over the retention channel 89, and/or (ii) a second longitudinally extending ridge or finger 84 extending from the strut 20 in the first longitudinal direction $x^1$ into or over the retention channel 89.

The strut 20, shelf 30, hook 40, protuberance 50, and retaining wall 80 may be constructed from the same or different materials. The strut 20, shelf 30, hook 40, protuberance 50 and retaining wall 80, or various combinations thereof, are preferably integrally formed from a single mass of material as a single unitary article. Materials from which the strut 20, shelf 30, hook 40, protuberance 50 and retaining wall 80 may be constructed include any material having the necessary structural integrity including specifically, but not exclusively: metals such as aluminum and steel; paper products such as cardboard and cardstock; plastics such as polyethylene and polyurethane; natural and synthetic rubbers; and wood. Selection of a suitable material is well within the competency of those having ordinary skill in the art.

As shown in FIGS. 7 through 11, a transducer 90, such as a microphone or piezoelectric sensor, may be permanently or releasably attached to the holder 10. An electrical contact 91 is electrically connected to the transducer 90 via electrical leads 92. The electrical contact 91 is configured and arranged to engage a mated electrical contact (not shown) on a tuner 500 retained by the holder 10. The electrical contact 91 on the holder 10 can be configured and arranged relative to the electrical contact (not shown) on the tuner 500 such that engagement of the contacts is effected automatically upon connection of the tuner 500 to the holder 10. Alternatively, the electrical contact 91 on the holder 10 can be configured and arranged relative to the electrical contact (not shown) on the tuner 500 such that engagement of the contacts requires manual manipulation of one or both of the electrical contacts after the tuner 500 is connected to the holder 10 (e.g., insertion of a male plug 91 at the end of an insulated electrical cord (unnumbered) extending from the holder 10 into a female input port (unnumbered) in the tuner 500). The transducer 90 can be positioned substantially anywhere on the holder 10, with a preference for the first major surface 33 of the shelf 30.

The transducer 90 is effective for sensing any vibration generated by the playing of a guitar string 410*a–f*, and converting the sensed vibration to an electrical signal having a value representative of the frequency of the sensed vibration. The electrical signal generated by the transducer 90 is transmitted to the tuner 500 through the electrical leads 92 and electrical contact 91. The tuner 500 is able to utilize the electrical signal received from the transducer 90 to generate a perceptible signal (i.e., a value on a visually perceptible pitch meter) indicating any difference between the frequency of the sensed vibration and a target frequency on a standard musical scale.

Figure 21:
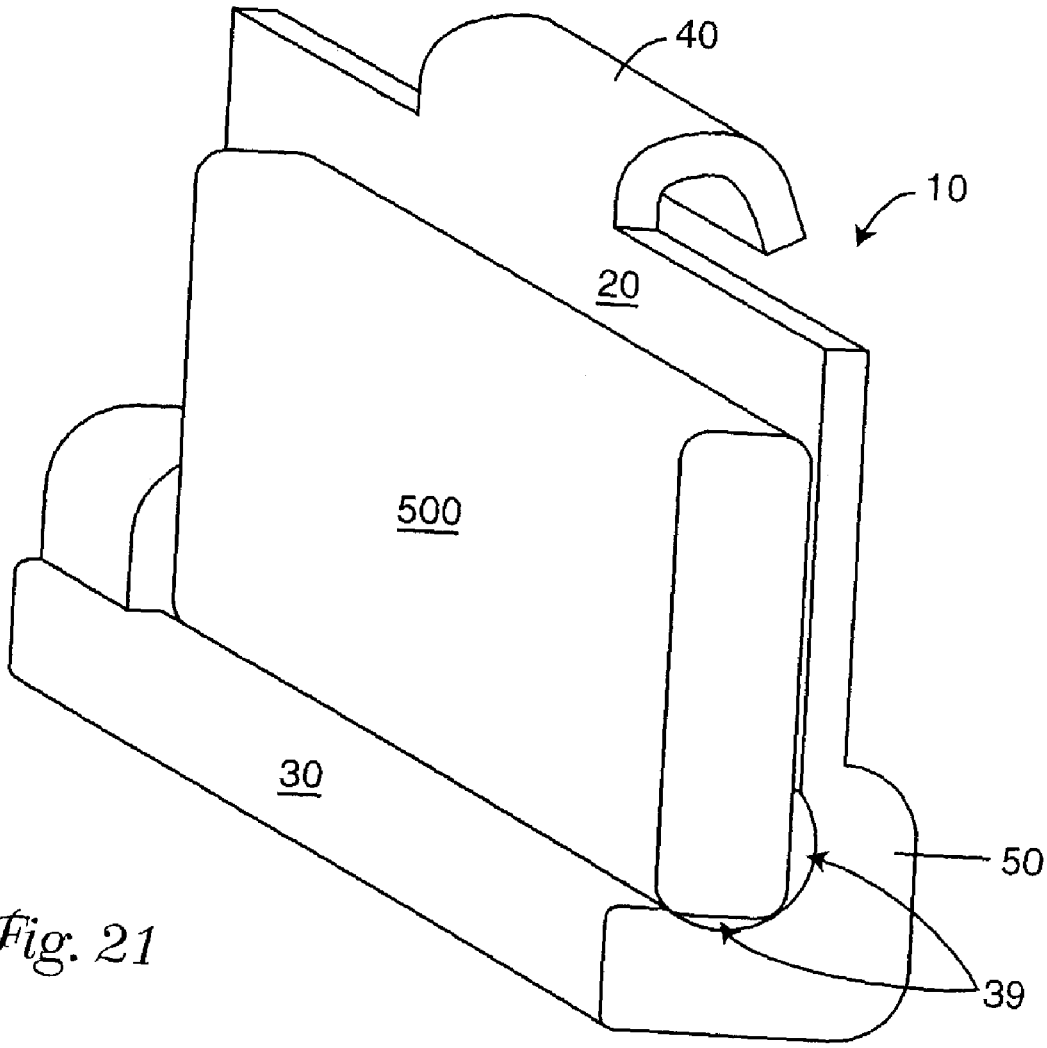
FIG. 21 is a perspective view of the invention shown in FIG. 14 holding a tuner in the storage position.
Figure 22:
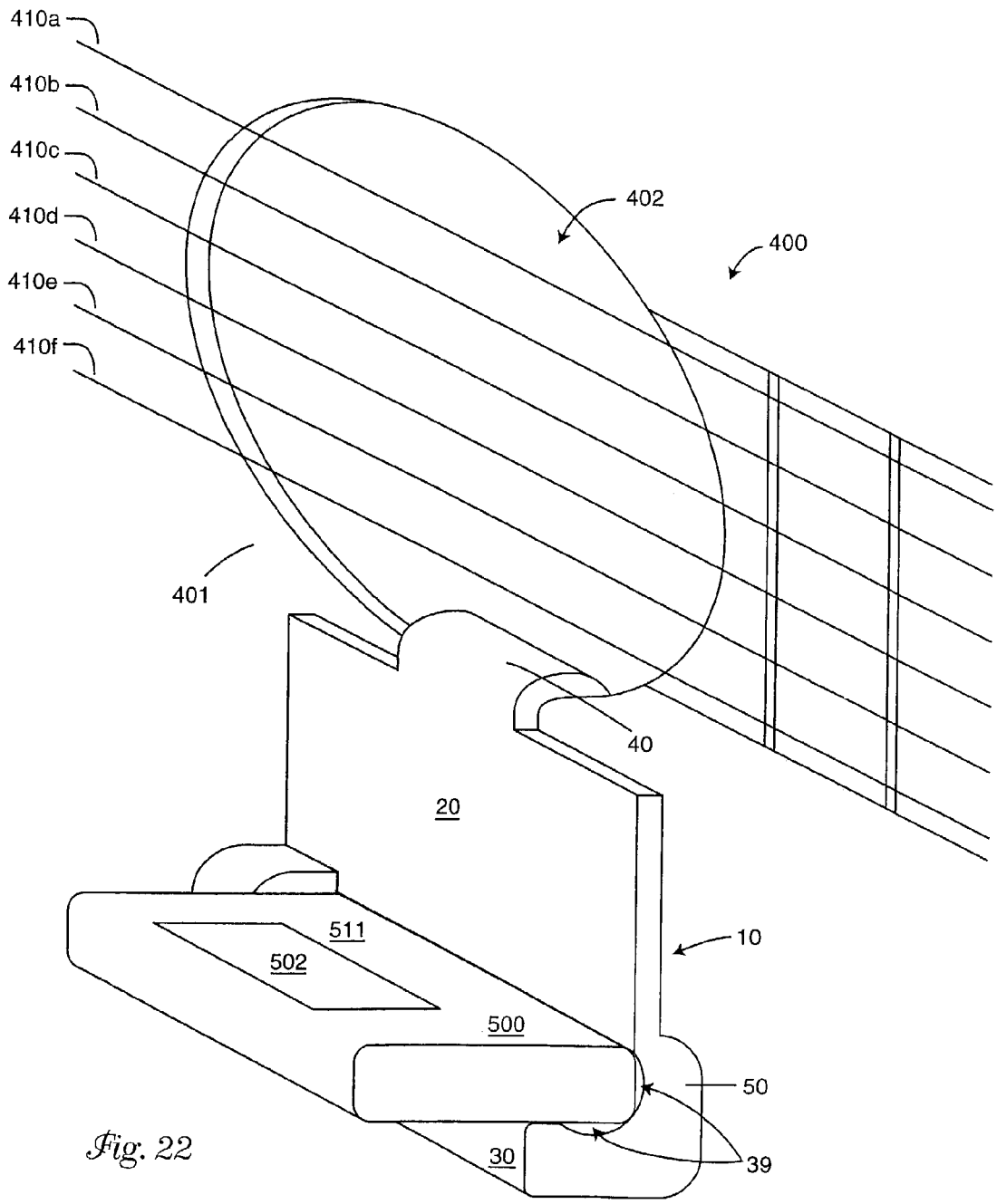
FIG. 22 is a perspective view of the invention shown in FIG. 14 suspended from the sound hole of a guitar and holding a tuner in the tuning position.

As shown in FIGS. 14 through 22, the holder 10 can be constructed with a laterally extending rotation channel 39 along the inside juncture of the strut 20 and the shelf 30, and a means for securing a tuner 500 to the holder 10 which allows pivoting of the tuner 500 about a lateral axis 30*y* as between a storage position, shown in FIG. 21, and a tuning position, shown in FIG. 22. When in the storage position, the front face 511 of the tuner 500 (i.e., the face having the visual tuning display 502) faces and rests against the first major surface 23 of the strut 20 (e.g., the front face 511 of the tuner 500 is substantially parallel to the first major surface 23 of the strut 20). When in the tuning position, the back face 512 of the tuner 500 faces and rests against the first major surface 33 of the shelf 30 (e.g., the front face 511 of the tuner 500 is substantially perpendicular to the first major surface 23 of the strut 20).

Figure 14:
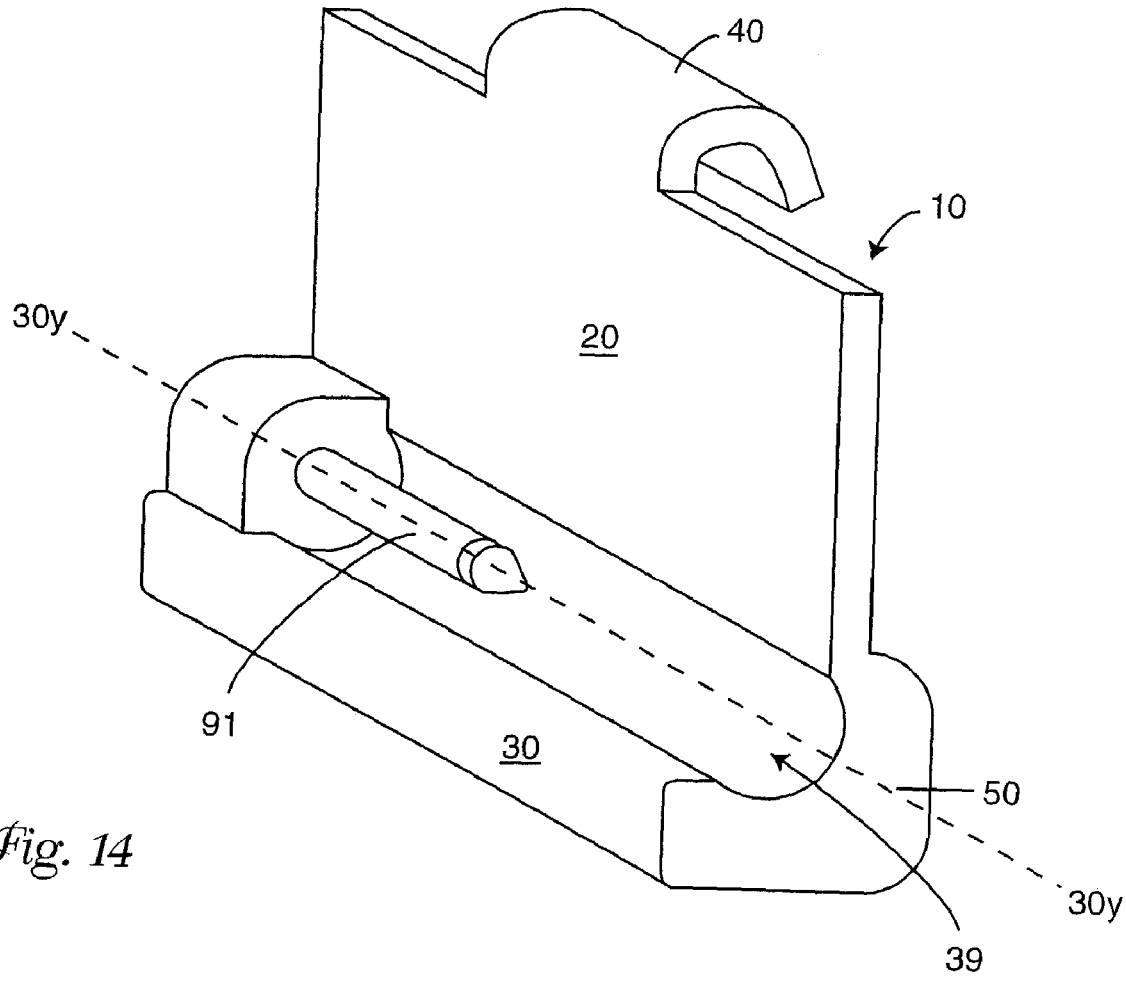
FIG. 14 is a perspective view of a sixth aspect of the first embodiment of the invention.
Figure 15:
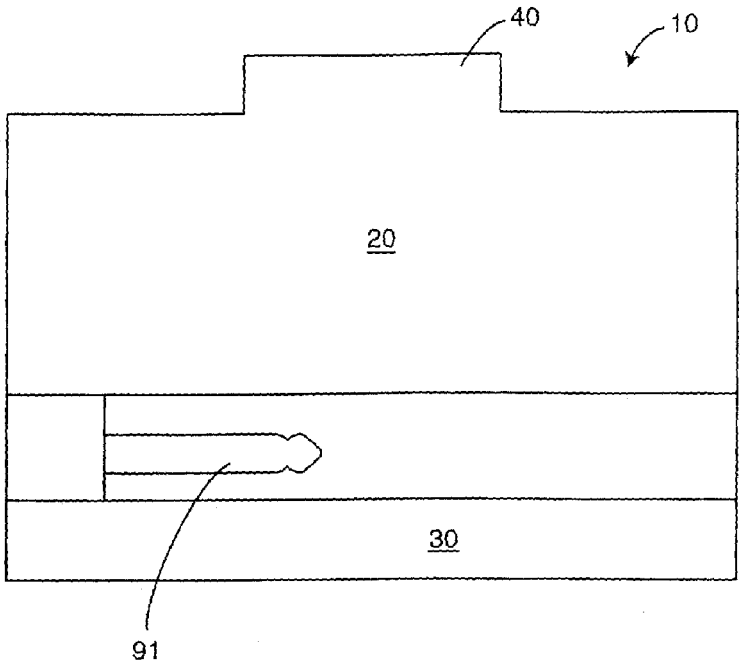
FIG. 15 is a front view of the invention shown in FIG. 14.
Figure 16:
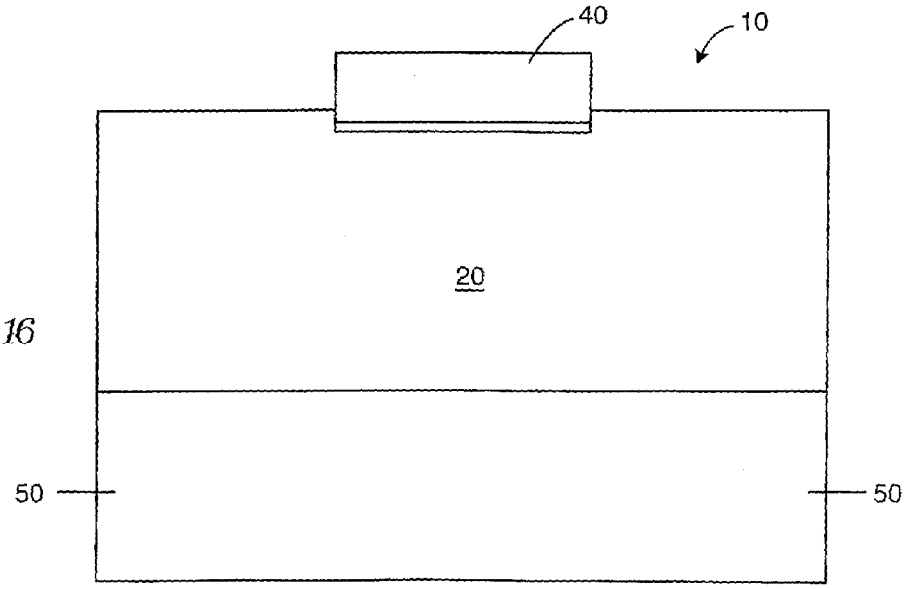
FIG. 16 is a back view of the invention shown in FIG. 14.
Figure 17:
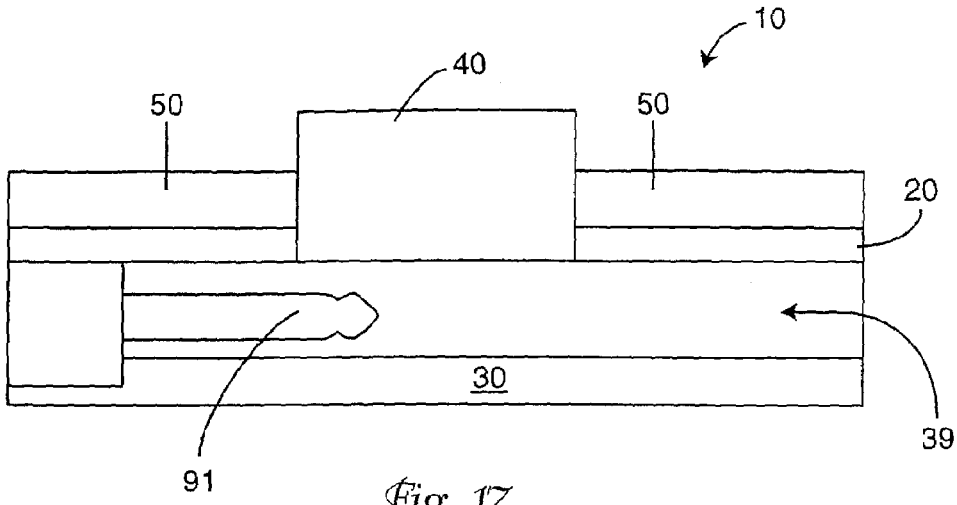
FIG. 17 is a top view of the invention shown in FIG. 14.
Figure 18:
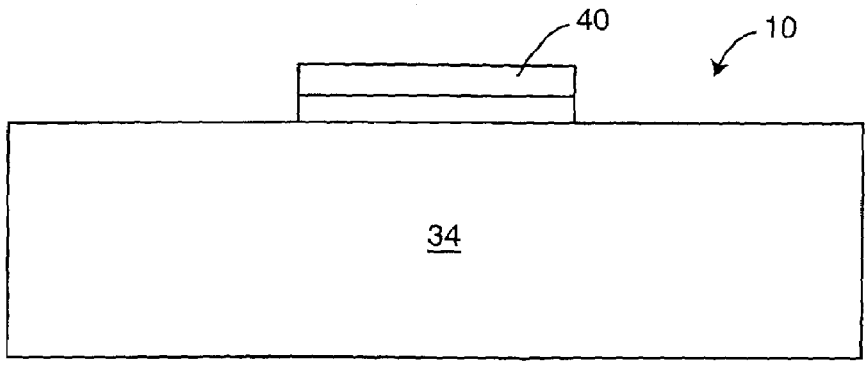
FIG. 18 is a bottom view of the invention shown in FIG. 14.
Figure 19:
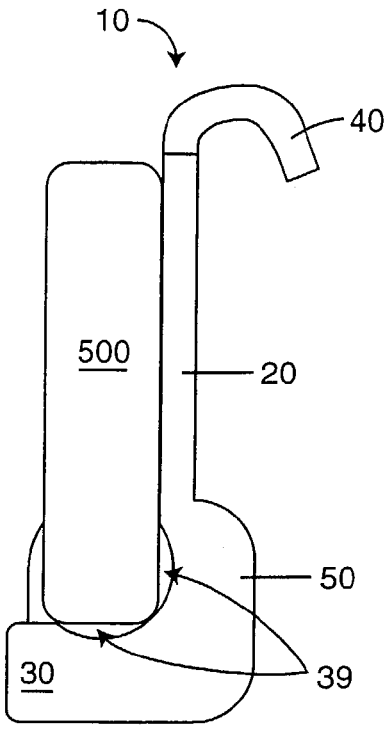
FIG. 19 is a right side view of the invention shown in FIG. 14.
Figure 20:
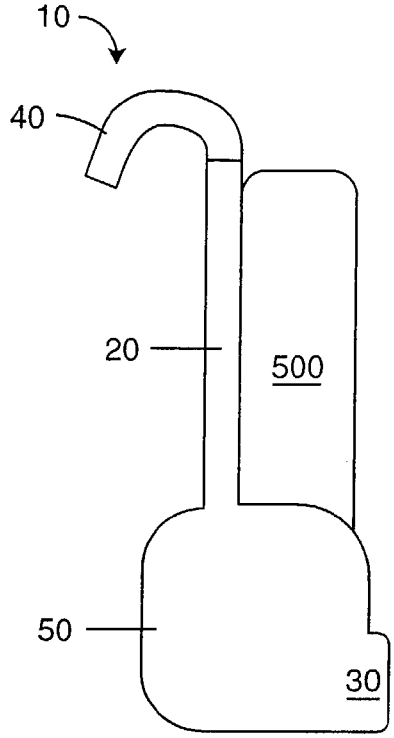
FIG. 20 is a left side view of the invention shown in FIG. 14.
Figure 19A:
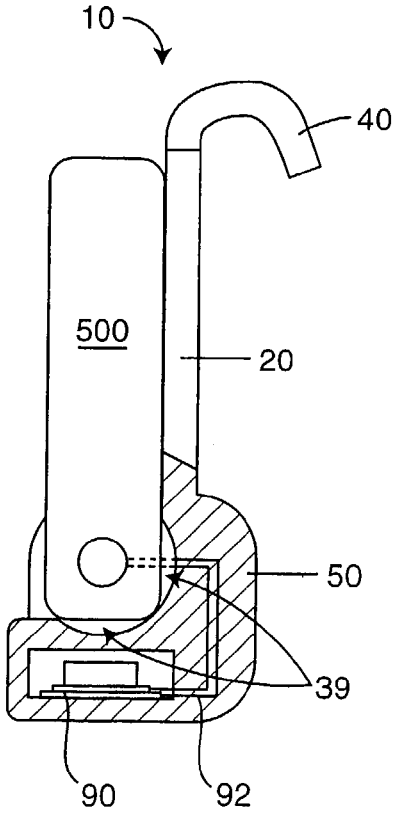
FIG. 19*a* is a right side view of the invention shown in FIG. 19 with a portion thereof removed to show the transducer.

A tuner 500 can be pivotally attached to the holder 10 in any number of ways known to those skilled in the art. As shown in FIGS. 14, 15 and 17, one such nonlimiting example is an axial-direction-locking cylindrical electrical contact 91 laterally extending from one side of the holder 10 into the rotation channel 39 for releasably engaging an electrical input port (not shown) in the tuner 500. The electrical contact 91 restricts lateral direction y movement of the tuner 500 relative to the holder 10 while permitting relatively unrestricted rotation of the tuner 500 about a lateral axis 30*y*.

Second Embodiment

Referring generally to FIGS. 23–32, a second embodiment of the invention is a guitar tuner holder 100, which includes an enclosure 110 and a hook 140.

The enclosure 110 has a longitudinally spaced front 111 and back 112, a transversely spaced top 113 and bottom 114, and a laterally spaced right side 115 and left side 116. The enclosure 110 defines a retention chamber 119. A first access opening 117' into the retention chamber 119 is provided through the top 113 of the enclosure 110. A second access opening 117" into the retention chamber 119 is provided through the front 111 of the enclosure 110.

As shown in FIGS. 23 and 31, the first access opening 117' through the top 113 of the enclosure 110 is configured and arranged to permit a major portion of a given guitar tuner 500 to be slidably introduced and engaged within the retention chamber 119 in a storage orientation. As shown in FIGS. 23 and 32, the second access opening 117" through the front 111 of the enclosure 110 is configured and arranged to permit a minor portion of the same given guitar tuner 500 to be slidably introduced and engaged within the retention chamber 119 in a tuning orientation. The second access opening 117" through the front 111 of the enclosure 110 is preferably transversely located proximate the bottom 114 of the enclosure 110.

As shown in FIG. 23, a transversely extending slot 118 is preferably provided through the front 111 of the enclosure 110 from the first access opening 117' to the second access opening 117" to facilitate removal of a tuner 500 stored within the retention chamber 119.

The walls of the enclosure 110 may be formed as a solid wall or an open framework, so long as the enclosure 110 is capable of securely retaining a given guitar tuner 500 in the storage and tuning positions.

The size and shape of the retention chamber 119 is preferably selected to mate with a given tuner 500. Generally, an appropriate fit can be achieved with a retention chamber 119 having a transverse height of 4 to 12 cm, a lateral width of 3 to 12 cm, and a longitudinal depth of 1 to 4 cm. More specifically, a transverse height of 6 to 10 cm, a lateral width of 4 to 6 cm, and a longitudinal depth of 2 to 3 cm will provide an appropriate fit with most commercially available tuners 500.

The hook 140 extends in a second longitudinal direction $x^2$ from the enclosure 110 away from the retention chamber 119 and defines a concavity 149 open towards the bottom 114 of the enclosure 110 (i.e., accessible in a first transverse direction $z^1$). The hook 140 preferably extends from the back 112 if the enclosure 110 proximate the top 113 of the enclosure 110, and most preferably transversely extends a distance above the top 113 of the enclosure 110 in the first transverse directions $z^1$ as well as a distance in the second longitudinal direction $x^2$.

The hook 140 is preferably laterally elongated so as to provide at least two laterally spaced points of contact (unnumbered) between the hook 140 and a guitar body 401 when the holder 100 is suspended from the sound hole 402 of the guitar 400 so as to increase the lateral direction y stability of the suspended holder 100.

The hook 40 preferably has a lateral width of 2 to 5 cm and a longitudinal depth of 1 to 2 cm.

The longitudinal depth of the concavity 149 defined by the hook 140 is preferably greater than the thickness of a standard guitar body 401 at the sound hole 402 in order to simplify hooking of the holder 100 onto a guitar body 401 and prevent the exertion of any clamping force upon a guitar body 401 by the hook 140 which could result in damage to the surface finish of the guitar body 401. Due to the oversized nature of the concavity 149, the holder 100 will tend to "lean" forward from a guitar body 401 when the holder 100 is suspended from the sound hole 402 of the guitar 400, causing the bottom 114 of the enclosure 110 to extend at a slight downward angle relative to a guitar body 401 (i.e., the inner major surface 114*a* of the bottom 114 of the enclosure 110 forms an angle of slightly more than 90° (e.g., between about 100° to 120°) with the face (unnumbered) of the guitar body 401). In order to return this angle closer to 90°, the holder 100 preferably includes a protuberance 150 which extends in the second longitudinal direction $x^2$ from proximate the bottom 114 of the enclosure 110. In a preferred aspect, the protuberance 150 extends a distance in the second longitudinal direction $x^2$ sufficient for causing the bottom 114 of the enclosure 110 to extend at a slight upward angle relative to a guitar body 401 when the holder 100 is suspended from the sound hole 402 of the guitar 400 (i.e., the inner major surface 114*a* of the bottom 114 of the enclosure 110 forms an angle of slightly less than 90° (e.g., between about 70° to 80°) with the face (unnumbered) of the guitar body 401). By causing the bottom 114 of the enclosure 110 to extend at a slight upward angle from the guitar body 401, the transducer 501, typically a microphone, and transducer sound opening 519 in a tuner 500 retained within the holder 100 in the tuning orientation will more directly face the guitar strings 410*a–f* and sound hole 402 of the guitar 400 and thereby improve the reception of sound emanating from the guitar 400 by the transducer 501, while also causing the visual tuning display 502 on the tuner 500 to more directly face the person (not shown) holding and tuning the guitar 400 and thereby facilitate viewing of the visual tuning display 502 during tuning of the guitar 400.

The protuberance 150 may be a single bump centered laterally on the enclosure 110, a pair of laterally spaced bumps, a plurality of laterally and transversely spaced bumps, a laterally elongated ridge, or any number of other structures effective for achieving the desired angling of the bottom 114 of the enclosure 110.

The protuberance 150 preferably has a longitudinal depth of 0.3 to 1 cm.

As shown in FIGS. 28 and 29, a layer of protective padding 160 is preferably placed over those portions of the holder 100 which contact the body 401 of a guitar 400 when the holder 100 is suspended from the guitar body 401 proximate the sound hole 402 in the guitar 400. The desired protection can generally be achieved by providing a layer of protective padding 160 over at least a portion of the exterior major surface 112*b* of the back 112 of the enclosure 110, at least a portion of the interior major surface 144 of the hook 140, and at least a portion of any protuberance 150 including at least the apex (unnumbered) of the protuberance 150. In order to maximize protection afforded by the protective padding 160, it is generally desired to provide a layer of protective padding 160 over the entire exterior major surface 112*b* of the back 112 of the enclosure 110, the entire exterior major surface 114*b* of the bottom 114 of the enclosure 110, the entire interior major surface 144 of the hook 140, and the entire exposed surface area of any protuberance 150.

Materials suitable for use as protective padding 160 include any material effective for protecting the surface finish of a guitar body 401 from scuff marks, abrasions and scratches include specifically, but not exclusively, felt, foamed thermoplastics, low durometer rubber and foamed rubber, etc. Selection of a suitable material for use as protective padding 160 is well within the competency of those having ordinary skill in the art.

The enclosure 110, hook 140 and protuberance 150 may be constructed from the same or different materials. The enclosure 110, hook 140 and protuberance 150, or various combinations thereof, are preferably integrally formed from a single mass of material as a single unitary article. Materials from which the enclosure 110, hook 140 and protuberance 150 may be constructed include any material having the necessary structural integrity including specifically, but not exclusively: metals such as aluminum and steel; paper products such as cardboard and cardstock; plastics such as polyethylene and polyurethane; natural and synthetic rubbers; and wood. Selection of a suitable material is well within the competency of those having ordinary skill in the art.

As shown in FIGS. 28, 29 and 30, a transducer 190, such as a microphone or piezoelectric sensor, may be permanently or releasably attached to the holder 100. Electrical contacts 191 are electrically connected to the transducer 190 via electrical leads 192. The electrical contacts 191 are configured and arranged to engage corresponding electrical contacts (not shown) on a tuner 500 when the tuner 500 is retained within the retention chamber 119 in the tuning orientation. The electrical contacts 191 on the holder 100 can be configured and arranged relative to the electrical contacts (not shown) on the tuner 500 such that engagement of the contacts is effected automatically upon placement of the tuner 500 within the retention chamber 119 in the tuning orientation. Alternatively, the electrical contacts 191 on the holder 100 can be configured and arranged relative to the electrical contacts (not shown) on the tuner 500 such that engagement of the contacts requires manual manipulation of one or both sets of electrical contacts 191 after the tuner 500 is placed within the retention chamber 119 in the tuning orientation (i.e., insertion of a male plug (not shown) at the end of an insulated electrical cord (not shown) extending from the holder 100 into a female input port (not shown) in the tuner 500). The transducer 190 can be positioned substantially anywhere on the holder 100, with a preference for the exterior major surface 112*b* of the back 112 of the enclosure 110.

The transducer 190 is effective for sensing any vibration generated by the playing of a guitar string 410*a–f*, and converting the sensed vibration to an electrical signal having a value representative of the frequency of the sensed vibration. The electrical signal generated by the transducer 190 is transmitted to the tuner 500 through the electrical leads 192 and electrical contacts 191. The tuner 500 is able to utilize the electrical signal received from the transducer 190 to generate a perceptible signal (i.e., a value on a visually perceptible pitch meter) indicating any difference between the frequency of the sensed vibration and a target frequency on a standard musical scale.

Third Embodiment

Referring generally to FIGS. 33–44, a third embodiment of the invention is a tuner holder 210, which includes a strut 220, a connection element 230, and a hook 240.

The strut 220 extends in a transverse direction z with a distal edge 221 transversely spaced in a second transverse direction $z^2$ from a proximal edge 222. The strut 20 may be sized, shaped and configured as desired so long as the strut 220 extends in a transverse direction z, is capable of securely supporting a tuner 500 attached to the connection element 230, and is capable of withstanding normal wear and tear. Acceptable configurations of the strut 220 include specifically but not exclusively, a rectangular plane, a rectangular plane with longitudinally extending side legs, a triangular plane, an ornamentally shaped plane, a framework of stiles and rails, an ornamental framework, a single central beam, a Y-shaped split beam, etc.

The strut 220 preferably has a transverse height of 2 to 5 cm and a lateral width of 1 to 10 cm.

In a preferred embodiment, the strut 220 includes (i) a central wall 220*c* defining a first major surface 223 facing a first longitudinal direction $x^1$ and a second major surface 224 facing a second longitudinal direction $x^2$, and (ii) laterally spaced right 220*r* and left 220*s* sidewalls extending in the first longitudinal direction $x^1$ from the right and left sides (unnumbered) of the central wall 220*c* respectively, for facilitating pivotable attachment of the connection element 230 to the strut 220.

The connection element 230 is pivotally attached to the strut 220 proximate the distal edge 221 of the strut 220 for pivoting about a lateral axis 230*y* as between at least a storage position, shown in FIG. 42, and a tuning position shown in FIG. 43. In the storage position, the front face 511 of the tuner 500 (i.e., the face having the visual tuning display 502) faces and abuts the first major surface 223 of the central wall 220*c* of the strut 220 (i.e., the front face 511 of the tuner 500 is substantially parallel to the first major surface 223 of the central wall 220*c* of the strut 220). In the tuning position, the front face 511 of the tuner 500 extends in a first longitudinal direction $x^1$ from the central wall 220*c* of the strut 220 facing the first transverse direction $z^1$ (i.e., the front face 511 of the tuner 500 is substantially perpendicular to the first major surface 223 of the central wall 220*c* of the strut 220).

The connection element 230 is preferably also pivotable about the lateral axis 230*y* into a display position, shown in FIG. 44, where the front face 511 of the tuner 500 is positioned so as to extend in both a second longitudinal direction $x^2$ and a first transverse direction $z^1$ from the lateral pivot axis 230*y*, and angularly face both the second longitudinal direction $x^2$ and the second transverse directions $z^2$ (i.e., the front face 511 of the tuner 500 is positioned at an angle of about 20° to 70° from the second major surface 224 of the central wall 220*c* of the strut 220). When the connection element 230 is pivoted into the display position, the strut 220 functions as a stand for the tuner 500 such that the holder 210 can placed face down on a flat surface (not shown) with the front face 511 of the tuner 500 extending upward from the surface (not shown) at an angle which facilitates hands-free viewing of the visual tuning display 502.

The connection element 230 can be pivotally attached to the strut 220 in any number of ways known to those skilled in the art. As shown in FIG. 34, one such nonlimiting example is a cylindrical pin 281 laterally extending from each side (unnumbered) of the connection element 230 proximate the proximal edge 233 of the connection element 230, wherein each pin 281 is mated with a circular orifice 282 in the right 220*r* and left 220*s* sidewalls of the strut 220. One or more laterally extending ribs 283 can be provided around each pin 281 for selectively mating with one of a series of angularly offset slots 284 circumferentially positioned around each circular orifice 282 for disengagably preventing continued rotation of the connection element 230 at each of the storage, tuning and display positions, as well as any other desired rotational position.

The connection element 230 preferably has a lateral width of 1 to 10 cm and a longitudinal depth of 3 to 10 cm.

The holder 210 includes a means 270 for releasably securing a tuner 500 to the connection element 230. As shown in FIGS. 33 and 34, an exemplary means 270 for securing a tuner 500 to the connection element 230 is a holding channel 239 configured and arranged to frictionally engage an end (unnumbered) of a tuner 500 within the holding channel 239. Retention of a tuner 500 within the holding channel 239 can be further facilitated through the use of an axial-direction locking cylindrical electrical contact 291 extending from the connection element 230 into the holding channel 239 for mated engagement with an input port (not shown) in a tuner 500 when the tuner 500 is slid into the holding channel 239.

Alternatively, the connection element 230 can be constructed as an integral part of the tuner housing 510.

The hook 240 extends in a second longitudinal direction $x^2$ from the strut 220 proximate the proximal edge 222 of the strut 220 and defines a concavity 249 open towards the distal edge 221 of the strut 220 (i.e., accessible in a first transverse direction $z^1$). The hook 240 is preferably laterally elongated so as to provide at least two laterally spaced points of contact between the hook 240 and a guitar body 401 when the holder 210 is suspended from the sound hole 402 of the guitar 400 so as to increase the lateral direction y stability of the suspended holder 210.

The hook 240 preferably has a lateral width of 2 to 5 cm and a longitudinal depth of 1 to 2 cm.

The longitudinal depth of the concavity 249 defined by the hook 240 is preferably greater than the thickness of a standard guitar body 401 at the sound hole 402 in order to simplify hooking of the holder 210 onto a guitar body 401 and prevent the exertion of any clamping force upon a guitar body 401 by the hook 240 which could result in damage to the surface finish of the guitar body 401. Due to the oversized nature of the concavity 249, the holder 210 will tend to "lean" forward from a guitar body 401 when the holder 100 is suspended from the sound hole 402 of the guitar 400, causing a tuner 500, retained within the holding channel 239 of the connection element 230 in the tuning position to extend at a slight downward angle relative to a guitar body 401 (i.e., the front face 511 of a tuner 500 retained within the holding channel 239 in the tuning position forms an angle of slightly more than 90° (e.g., between about 100° to 120°) with the face (unnumbered) of the guitar body 401). In order to return this angle closer to 90°, the holder 210 preferably includes a protuberance 250 which extends in the second longitudinal direction $x^2$ from proximate the distal edge 221 of the strut 220. In a preferred aspect, the protuberance 150 extends a distance in the second longitudinal direction $x^2$ sufficient for causing a tuner 500, retained within the holding channel 239 of the connection element 230 in the tuning position, to extend at a slight upward angle relative to a guitar body 401 (i.e., the front face 511 of a tuner 500, retained within the holding channel 239 in the tuning position, forms an angle of slightly less than 90° (e.g., between about 70° to 80°) with the face (unnumbered) of the guitar body 401).). By causing the front face 511 of a tuner 500 retained within the holding channel 239 of the connection element 230 to extend at a slight upward angle from the guitar body 401 when in the tuning position, the transducer 501, typically a microphone, and transducer sound opening 519 in tuner 500 will more directly face the guitar strings 410*a–f* and sound hole 402 of the guitar 400 and thereby improve the reception of sound emanating from the guitar 400 by the transducer 501, while also causing the visual tuning display 502 on the tuner 500 to more directly face the person (not shown) holding and tuning the guitar 400 and thereby facilitate viewing of the visual tuning display 502 during tuning of the guitar 400.

The holder 210 preferably includes a protuberance 250 which extends in the second longitudinal direction $x^2$ from the strut 220 proximate the distal edge 221 of the strut 220 for causing a tuner 500, retained within the holding channel 239 of the connection element 230 in the tuning position, to extend at a slight upward angle relative to a guitar body 401 when the holder 210 is suspended from the sound hole 402 of the guitar 400 (i.e., the front face 511 of a tuner 500 retained within the holding channel 239 in the tuning position forms an angle of slightly less than 90° (e.g., between about 70° to 80°) with the face (unnumbered) of the guitar body 401). By causing the front face 511 of a tuner 500 retained within the holding channel 239 of the connection element 230 to extend at a slight upward angle from the guitar body 401 when in the tuning position, the transducer 501, typically a microphone, and transducer sound opening 519 in tuner 500 will more directly face the guitar strings 410*a–f* and sound hole 402 of the guitar 400 and thereby improve the reception of sound emanating from the guitar 400 by the transducer 501, while also causing the visual tuning display 502 on the tuner 500 to more directly face the person (not shown) holding and tuning the guitar 400 and thereby facilitate viewing of the visual tuning display 502 during tuning of the guitar 400.

The protuberance 250 may be a single bump centered laterally on the strut 220, a pair of laterally spaced bumps, a plurality of laterally and transversely spaced bumps, a laterally elongated ridge, or any number of other structures effective for achieving the desired angling of a tuner 500 retained within the holding channel 239 of the connection element 230 in the tuning orientation.

The protuberance 250 preferably has a longitudinal depth of 0.3 to 1 cm. As shown in FIGS. 39 and 40, a layer of protective padding 260 is preferably placed over those portions of the holder 210 which contact a guitar body 401 when the holder 210 is suspended from a guitar body 401 proximate the sound hole 402 in the guitar 400. The desired protection can generally be achieved by providing a layer of protective padding 260 over at least a portion of the second major surface 224 of the central wall 220*c* of the strut 220, at least a portion of the interior major surface 244 of the hook 240, and at least a portion of any protuberance 250 including at least the apex (unnumbered) of the protuberance 250. In order to maximize protection afforded by the protective padding 260, it is generally desired to provide a layer of protective padding 260 over the entire second major surface 224 of the central wall 220*c* of the strut 220, the entire exterior surface (unnumbered) of the connection element 230, the entire interior major surface 244 of the hook 240, and the entire exposed surface area of any protuberance 250.

Materials suitable for use as protective padding 260 include any material effective for protecting the surface finish of a guitar body 401 from scuff marks, abrasions and scratches include specifically, but not exclusively, felt, foamed thermoplastics, low durometer rubber and foamed rubber, etc. Selection of a suitable material for use as protective padding 260 is well within the competency of those having ordinary skill in the art.

The strut 220, hook 240 and protuberance 250 may be constructed from the same or different materials. The strut 220, hook 240 and protuberance 250, or various combinations thereof, are preferably integrally formed from a single mass of material as a single unitary article. Materials from which the strut 220, hook 240 and protuberance 250, as well as the connection element 230, may be constructed include any material having the necessary structural integrity including specifically, but not exclusively: metals such as aluminum and steel; paper products such as cardboard and cardstock; plastics such as polyethylene and polyurethane; natural and synthetic rubbers; and wood. Selection of a suitable material is well within the competency of those having ordinary skill in the art.

As shown in FIGS. 34 and 41, a transducer 290, such as a microphone or piezoelectric sensor, may be permanently or releasably attached to the holder 210. An electrical contact 291 is electrically connected to the transducer 290 via electrical leads 292. The electrical contact 291 is configured and arranged to engage an electrical contact (not shown) on a tuner 500 retained by the connection element 230. The electrical contact 291 on the holder 210 can be configured and arranged relative to the electrical contact (not shown) on the tuner 500 such that engagement of the contacts is effected automatically upon engagement of the tuner 500 to the connection element 230. Alternatively, the electrical contact 291 on the holder 210 can be configured and arranged relative to the electrical contact (not shown) on the tuner 500 such that engagement of the contacts requires manual manipulation of one or both of the electrical contacts after the tuner 500 is engaged by the connection element 230 (i.e., insertion of a male plug (not shown) at the end of an insulated electrical cord (unnumbered) extending from the holder 210 into a female input port (not shown) in the tuner 500. The transducer 290 can be positioned substantially anywhere on the holder 210, with a preference for the interior (unnumbered) of the connection element 230.

The transducer 290 is effective for sensing any vibration generated by the playing of a guitar string 410*a–f* and converting the sensed vibration to an electrical signal having a value representative of the frequency of the sensed vibration. The electrical signal generated by the transducer 290 is transmitted to the tuner 500 through the electrical leads 292 and electrical contact 291. The tuner 500 is able to utilize the electrical signal received from the transducer 290 to generate a perceptible signal (i.e., a value on a visually perceptible pitch meter) indicating any difference between the frequency of the sensed vibration and a target frequency on a standard musical scale.

Fourth Embodiment

Referring generally to FIGS. 45–58, a fourth embodiment of the invention is an assembly (unnumbered) which includes (i) a guitar tuner 300 having a transducer 301 (e.g., a microphone) and a visual tuning display 302 retained within a housing 310, and (ii) a hook 340 extending from the housing 310.

The housing 310 has longitudinally spaced front 311 and back 312 walls, transversely spaced top 313 and bottom 314 walls, and laterally spaced a right 315 and left 316 sidewalls. The housing 310 may have substantially any size and shape so long as the housing 310 is large enough to retain those electronic components (not shown) necessary for proper functioning of the tuner 300 and small enough to facilitate use, transportation and storage of the tuner 300. Generally, a housing 310 having a transverse height of 4 to 12 cm, a lateral width of 3 to 12 cm, and a longitudinal depth of 1 to 4 cm accommodates these basic requirements. More preferably, the housing 310 has a transverse height of 6 to 10 cm, a lateral width of 4 to 6 cm, and a longitudinal depth of 2 to 3 cm.

When the transducer 301 of the tuner 300 is selected to sense acoustic vibrations or waves, the transducer 301 is aligned with a sound opening 319 through the housing 310 for receiving acoustic signals from a guitar 400. The sound opening 319 may be positioned substantially anywhere on the housing 310, but is preferably placed through the front wall 311.

The hook 340 extends in a second longitudinal direction $x^2$ from the housing 310 and defines a concavity 349 open towards the bottom wall 314 of the housing 310 (i.e., accessible in the first transverse direction $z^1$). The hook 340 preferably extends from the back wall 312 of the housing 310 proximate the top wall 313 of the housing 310, and most preferably transversely extends a distance above the top wall 313 of the housing 310 in the first transverse direction $z^1$.

The hook 340 is preferably laterally elongated so as to provide at least two laterally spaced points of contact (unnumbered) between the hook 340 and the guitar body 401 when the tuner 300 is suspended from the sound hole 402 of the guitar 400 so as to increase the lateral direction y stability of the suspended tuner 300.

The hook 340 preferably has a lateral width of 2 to 5 cm and a longitudinal depth of 1 to 2 cm.

As shown in FIGS. 53 through 55, the hook 340 may be slidably connected to the housing 310 for longitudinally sliding between at least a storage position, shown in FIG. 54, and a tuning position, shown in FIG. 54. In the storage position, shown in FIG. 55, the hook 340 is drawn toward the housing 310 such that the concavity 349 defined by the hook 340 is not reasonably accessible. In the tuning position, the hook 340 is extended from the housing 310 so as to permit access to the concavity 349 defined by the hook 340 in a first transverse direction $z^1$ and thereby allow hooking of the tuner 300 onto a guitar body 401 proximate the sound hole 402.

As shown in FIGS. 56 through 58, the hook 340 may be pivotally connected to the housing 310 for pivoting about a lateral axis (not shown) between at least a storage position shown in FIG. 58, and a tuning position, shown in FIG. 57. In the storage position, the hook 340 is drawn toward the housing 310 such that the concavity 349 defined by the hook 340 is not reasonably accessible. In the tuning position, the hook 340 is extended from the housing 310 so as to permit hooking of the tuner 300 onto a guitar body 401 proximate the sound hole 402.

The assembly (unnumbered) may optionally include a transversely extending strut 320 interposed between the housing 310 and the hook 340 with a distal edge 321 of the strut 320 attached to the housing 310 and a proximal edge 322 of the strut 320 attached to the hook 340. The strut 320 is effective for transversely spacing the tuner 300 from the hook 340 and thereby transversely spacing the tuner 300 from the guitar strings 410*a–f* of a guitar when the tuner 300 is suspended from the sound hole 402 of a guitar 400 by the hook 340. The strut 320 may be sized, shaped and configured as desired so long as the strut 320 extends in a transverse direction z, is capable of securely suspending the tuner 300 from the sound hole 402 of a guitar 400, and capable of withstanding normal wear and tear. Acceptable configurations include specifically but not exclusively, a rectangular plane, a triangular plane, an ornamentally shaped plane, a framework of stiles and rails, an ornamental framework, a single central beam, a Y-shaped split beam, etc.

The strut 320 preferably has a transverse height of 1 to 5 cm and a lateral width of 1 to 10 cm.

In a preferred embodiment, the strut 320 defines a first major surface 323 facing a first longitudinal direction $x^1$ and a second major surface 324 facing a second longitudinal direction $x^2$.

The longitudinal depth of the concavity 349 defined by the hook 340 is preferably greater than the thickness of a standard guitar body 401 at the sound hole 402 in order to simplify hooking of the assembly (unnumbered) onto a guitar body 401 and prevent the exertion of any clamping force upon a guitar body 401 by the hook 340 which could result in damage to the surface finish of the guitar body 401. Due to the oversized nature of the concavity 349, the tuner 300 will tend to "lean" forward from a guitar body 401 when the assembly (unnumbered) is suspended from the sound hole 402 of the guitar 400, causing the bottom wall 314 of the tuner housing 310 to extend at a slight downward angle relative to a guitar body 401 (i.e., the bottom wall 314 of the housing 310 forms an angle of slightly more than 90° (e.g., between about 100° to 120°) with the face (unnumbered) of the guitar body 401). In order to return this angle closer to 90°, the assembly (unnumbered) preferably includes a protuberance 350 which extends in the second longitudinal direction $x^2$ from proximate the bottom wall 314 of the housing 310. In a preferred aspect, the protuberance 350 extends a distance in the second longitudinal direction $x^2$ sufficient for causing the bottom wall 314 of the housing 310 to extend at a slight upward angle relative to a guitar body 401 when the assembly (unnumbered) is suspended from the sound hole 402 of the guitar 400 (i.e., the bottom wall 314 of the housing 310 forms an angle of slightly less than 90° (e.g., between about 70° to 80°) with the face (unnumbered) of the guitar body 401). By causing the bottom wall 314 of the housing 310 to extend at a slight upward angle from the guitar body 401, the transducer 301, typically a microphone, and transducer sound opening 319 in the tuner 300 will more directly face the guitar strings 410*a–f* and sound hole 402 of the guitar 400 and thereby improve the reception of sound emanating from the guitar 400 by the transducer 301, while also causing the visual tuning display 302 on the tuner 300 to more directly face the person (not shown) holding and tuning the guitar 400 and thereby facilitate viewing of the visual tuning display 302 during tuning of the guitar 400.

The protuberance 350 may be a single bump centered laterally on the housing 310, a pair of laterally spaced bumps, a plurality of laterally and transversely spaced bumps, a laterally elongated ridge, or any number of other structures effective for achieving the desired angling of the tuner 300.

The protuberance 50 preferably has a longitudinal depth of 0.3 to 1 cm.

As shown in FIGS. 45, 50, 51 and 52, a layer of protective padding 360 is preferably placed over those portions of the tuner 300 which contact a guitar body 401 when the tuner 300 is suspended from a guitar body 401 proximate the sound hole 402 in the guitar 400. The desired protection can generally be achieved by providing a layer of protective padding 360 over at least a portion of the exterior major surface 312*e* of the back wall 312 of the housing 310, at least a portion of the interior major surface 344 of the hook 340, and at least a portion of any protuberance 350 including at least the apex (unnumbered) of the protuberance 350. In order to maximize protection afforded by the protective padding 360, it is generally desired to provide a layer of protective padding 360 over the entire exterior major surface 312*e* of the back wall 312 of the housing 310, the entire exterior major surface 314*e* of the bottom wall 314 of the housing 310, the entire interior major surface 344 of the hook 340, and the entire exposed surface area of any protuberance 350.

Materials suitable for use as protective padding 360 include any material effective for protecting the surface finish of a guitar body 401 from scuff marks, abrasions and scratches include specifically, but not exclusively, felt, foamed thermoplastics, low durometer rubber and foamed rubber, etc. Selection of a suitable material for use as protective padding 360 is well within the competency of those having ordinary skill in the art.

The housing 310, hook 340 and protuberance 350 may be constructed from the same or different materials. At least a portion of the housing 310, the hook 340 and the protuberance 350, or various combinations thereof, are preferably integrally formed from a single mass of material as a single unitary article. Materials from which the housing 310, hook 340 and protuberance 350 may be constructed include any material having the necessary structural integrity including specifically, but not exclusively: metals such as aluminum and steel; paper products such as cardboard and cardstock; plastics such as polyethylene and polyurethane; natural and synthetic rubbers; and wood. Selection of a suitable material is well within the competency of those having ordinary skill in the art.

As shown in FIG. 52 a transducer 301, such as a microphone or piezoelectric sensor, is provided within the housing 310. The transducer 301 is effective for sensing the vibration generated by the playing of a guitar string 410*a–f*, and converting the sensed vibration to an electrical signal having a value representative of the frequency of the sensed vibration. The tuner 300 includes the necessary hardware, software and/or firmware (not shown) to generate a perceptible signal (i.e., a value on a visually perceptible pitch meter) indicating any difference between the frequency of the sensed vibration and a target frequency on a standard musical scale.

I claim:

1. A tuner holder comprising:

(a) a strut having transversely spaced distal and proximal edges;

(b) a shelf extending substantially perpendicular in a first longitudinal direction from the distal edge of the strut;

(c) a hook extending in a second longitudinal direction from the proximal edge of the strut; and (d) a means for securing a tuner to the holder;

wherein (i) the strut extends in a first transverse direction from the shelf, (ii) the shelf has longitudinally spaced distal and proximal edges with the proximal edge proximate the strut, (iii) the holder further comprises a retaining wall extending in the first transverse direction from the shelf proximate the distal edge of the shelf; (iv) a retention channel is formed by the strut, shelf and retaining wall, and (v) the retaining wall can be elastically deflected away from the strut whereby a tuner may be inserted into the retention channel by deflection of the retaining wall from a closed position to an open position, an inserted tuner may be securely retained within the retention channel upon return of the deflected retaining wall to the closed position, and the inserted tuner may be removed from the retention channel by deflection of the retaining wall from the closed position to the open position.

2. The holder of claim 1 further comprising first and second fingers extending over the retention channel with the first finger longitudinally extending from proximate the distal end of the retaining wall in the second longitudinal direction, and the second finger longitudinally extending from the strut in the first longitudinal direction.

3. A stringed instrument tuner holder, comprising:

(a) an enclosure having a front longitudinally spaced from a back, a top transversely spaced from a bottom, a right side laterally spaced from a left side, and defining a retention chamber accessible through access openings in both the top and front of the enclosure, wherein (i) the access opening through the top of the enclosure is configured and arranged to permit a major portion of a given tuner to be slidably introduced in a second transverse direction and engaged within the retention chamber in a storage orientation, and (ii) the access opening through the front of the enclosure is configured and arranged to permit a minor portion of the same given tuner to be slidably introduced and engaged within the retention chamber in a tuning orientation; and (b) a hook longitudinally extending from the enclosure away from the retention chamber and defining a concavity accessible in a first transverse direction.

4. The holder of claim 3 wherein the access opening through the front of the enclosure is transversely located proximate the bottom of the enclosure.

5. The holder of claim 4 wherein the enclosure further comprises a transversely extending slot through the front of the enclosure extending from the access opening through the top of the enclosure to the access opening through the front of the enclosure.

6. The holder of claim 5 wherein the retention chamber has a transverse height of 6 to 10 cm, a lateral width of 4 to 6 cm, and a longitudinal depth of 2 to 3 cm.

7. The holder of claim 5 wherein (i) the back of the enclosure has a first major surface facing toward the retention chamber and a second major surface facing away from the retention chamber, (ii) the hook defines an exterior major surface and an interior major surface, and (iii) the layer of protective padding covers at least a portion of the second major surface of the back of the enclosure and at least a portion of the interior major surface of the hook.

8. The holder of claim 3 further comprising a protuberance extending from the back of the enclosure away from the retention chamber proximate the bottom of the enclosure.

9. The holder of claim 3 wherein the hook is positioned proximate the top of the enclosure.

10. The holder of claim 9 wherein the hook transversely extends above the top of the enclosure.

11. The holder of claim 3 wherein the front, back, top, bottom, first side and second side of the enclosure and the hook are integrally formed as a single unitary article.

12. The holder of claim 3 wherein the retention chamber has a transverse height of 4 to 12 cm, a lateral width of 3 to 12 cm, and a longitudinal depth of 1 to 4 cm.

13. The holder of claim 3 further comprising a layer of protective padding over those portions of the holder which contact a stringed instrument body when the holder is used to suspend a tuner from a stringed instrument body proximate a sound hole.

14. The holder of claim 3 further comprising (i) a transducer attached to the enclosure effective for sensing the vibration generated by effecting vibration of a string on a stringed instrument and converting the sensed vibration to an electrical signal, and (ii) a means for electrically connecting the transducer to a tuner when the tuner is engaged within the retention chamber in the tuning orientation, for transmitting the electric signal from the transducer to the tuner.

15. The holder of claim 14 wherein (i) the transducer is a piezoelectric sensor, and (ii) the means for electrically connecting the piezoelectric sensor to a tuner is effective for automatically electrically connecting the piezoelectric sensor to a tuner when the tuner engaged within the retention chamber in the tuning orientation.

16. The holder of claim 14 wherein the transducer is releasably attached to the enclosure.

17. A method of tuning a stringed instrument having a sound hole, comprising:

(a) obtaining a tuner for the stringed instrument;

(b) obtaining the holder of claim 3;

(c) securing the tuner to the holder in the tuning orientation;

(d) hanging the tuner from the stringed instrument proximate the sound hole by hooking the holder onto the stringed instrument at the sound hole;

(e) playing a string on the stringed instrument so as to generate a vibration having a frequency; and (f) adjusting the tension on the played string based upon a perceptible signal generated by the tuner indicating the frequency of the vibration relative to a target frequency on a standard musical scale.

18. A method of tuning a stringed instrument having a sound hole, comprising:

(a) obtaining a tuner for the stringed instrument;

(b) obtaining the holder of claim 14;

(c) securing the tuner to the holder in the tuning orientation;

(d) electrically connecting the tuner to the transducer;

(e) hanging the tuner from the stringed instrument proximate the sound hole by hooking the holder onto the stringed instrument at the sound hole;

(f) playing a string on the stringed instrument so as to generate a vibration having a frequency and thereby effect (i) generation of an electrical signal by the transducer corresponding to the frequency of the vibration, (ii) transmission of the electrical signal from the transducer to the tuner, and (iii) generation of a perceptible signal by the tuner representative of any difference between the frequency of the vibration and a target frequency on a standard musical scale; and (g) adjusting the tension on the played string based upon the perceptible signal.

19. A combination, comprising:

(a) a tuner including at least:

(1) a housing, and (2) a transducer having an access port through the housing, and (b) a tuner holder, including at least:

(1) an enclosure having a front longitudinally spaced from a back, a top transversely spaced from a bottom, a right side laterally spaced from a left side, and defining a retention chamber accessible through access openings in both the top and front of the enclosure, wherein (i) the access opening through the top of the enclosure is configured and arranged to permit a major portion of the tuner to be slidably introduced and engaged within the retention chamber in a storage orientation relative to the enclosure with the transducer access port through the housing of the tuner positioned within the retention chamber and facing the back of the enclosure, and (ii) the access opening through the front of the enclosure is configured and arranged to permit a minor portion of the tuner to be slidably introduced and engaged within the retention chamber in a tuning orientation relative to the enclosure with the transducer access port through the housing of the tuner positioned outside the retention chamber and facing the top of the enclosure, and (2) a hook longitudinally extending from the back of the enclosure away from the retention chamber.

20. The combination of claim 19 wherein the access opening through the front of the enclosure is transversely located proximate the bottom of the enclosure.

21. The combination of claim 20 wherein the enclosure further comprises a transversely extending slot through the front of the enclosure extending from the access opening through the top of the enclosure to the access opening through the front of the enclosure.

22. The combination of claim 21 wherein the retention chamber has a transverse height of 6 to 10 cm, a lateral width of 4 to 6 cm, and a longitudinal depth of 2 to 3 cm.

23. The combination of claim 21 wherein (i) the back of the enclosure has a first major surface facing toward the retention chamber and a second major surface facing away from the retention chamber, (ii) the hook defines an exterior major surface and an interior major surface, and (iii) the layer of protective padding covers at least a portion of the second major surface of the back of the enclosure and at least a portion of the interior major surface of the hook.

24. The combination of claim 21 further comprising a protuberance extending from the back of the enclosure away from the retention chamber proximate the bottom of the enclosure.

25. The combination of claim 24 wherein the hook is positioned proximate the top of the enclosure.

26. The combination of claim 25 wherein the hook transversely extends above the top of the enclosure.

27. The combination of claim 19 wherein the front, back, top, bottom, first side and second side of the enclosure and the hook are integrally formed as a single unitary article.

28. The combination of claim 19 wherein the retention chamber has a transverse height of 4 to 12 cm, a lateral width of 3 to 12 cm, and a longitudinal depth of 1 to 4 cm.

29. The combination of claim 19 further comprising a layer of protective padding over those portions of the holder which contact a stringed instrument body when the holder is used to suspend a tuner from a stringed instrument body proximate a sound hole.

30. The combination of claim 19 further comprising (i) a second transducer attached to the holder effective for sensing the vibration generated by effecting vibration of a string on a stringed instrument and converting the sensed vibration to an electrical signal, and (ii) a means for electrically connecting the second transducer to the tuner when the tuner is engaged within the retention chamber in the tuning orientation, for transmitting electric signals from the second transducer to the tuner.

31. The combination of claim 30 wherein (i) the transducer is a piezoelectric sensor, and (ii) the means for electrically connecting the piezoelectric sensor to the tuner is effective for automatically electrically connecting the piezoelectric sensor to the tuner when the tuner is engaged within the retention chamber in the tuning orientation.

32. The combination of claim 30 wherein the transducer is releasably attached to the enclosure.

33. A method of tuning a stringed instrument having a sound hole, comprising:

(a) obtaining the combination of claim 19;

(b) slidably engaging the tuner within the retention chamber of the holder in the tuning orientation;

(c) hanging the tuner from the stringed instrument proximate the sound hole by hooking the holder onto the stringed instrument at the sound hole;

(d) playing a string on the stringed instrument so as to generate a vibration having a frequency; and (e) adjusting the tension on the played string based upon a perceptible signal generated by the tuner indicating the frequency of the vibration relative to a target frequency on a standard musical scale.

34. A method of tuning a stringed instrument having a sound hole, comprising:

(a) obtaining the combination of claim 30;

(b) slidably engaging the tuner within the retention chamber of the holder in the tuning orientation;

(c) electrically connecting the tuner to the second transducer;

(d) hanging the tuner from the stringed instrument proximate the sound hole by hooking the holder onto the stringed instrument at the sound hole;

(e) playing a string on the stringed instrument so as to generate a vibration having a frequency and thereby effect (i) generation of an electrical signal by the second transducer corresponding to the frequency of the vibration, (ii) transmission of the electrical signal from the transducer to the tuner, and (iii) generation of a perceptible signal by the tuner representative of any difference between the frequency of the vibration and a target frequency on a standard musical scale; and (f) adjusting the tension on the played string based upon the perceptible signal.

* * * * *